US010221747B2

(12) United States Patent
Suchezky et al.

(10) Patent No.: US 10,221,747 B2
(45) Date of Patent: Mar. 5, 2019

(54) VALVULAR-CONDUIT MANIFOLD

(71) Applicant: WILLIAMS INTERNATIONAL CO., L.L.C., Walled Lake, MI (US)

(72) Inventors: Mark E. Suchezky, South Lyon, MI (US); James B. Drobnis, West Bloomfield, MI (US)

(73) Assignee: WILLIAMS INTERNATIONAL CO., L.L.C., Pontiac, MI (US)

( * ) Notice: Subject to any disclaimer, the term of this patent is extended or adjusted under 35 U.S.C. 154(b) by 114 days.

(21) Appl. No.: 15/035,069

(22) PCT Filed: Aug. 20, 2015

(86) PCT No.: PCT/US2015/046036

§ 371 (c)(1),
(2) Date: May 6, 2016

(87) PCT Pub. No.: WO2016/028974

PCT Pub. Date: Feb. 25, 2016

(65) Prior Publication Data

US 2016/0281579 A1 Sep. 29, 2016

Related U.S. Application Data

(60) Provisional application No. 62/040,258, filed on Aug. 21, 2014.

(51) Int. Cl.
*F15C 1/00* (2006.01)
*F01N 13/10* (2010.01)
(Continued)

(52) U.S. Cl.
CPC ..... *F01N 13/10* (2013.01); *F01N 1/08* (2013.01); *F01N 13/1888* (2013.01);
(Continued)

(58) Field of Classification Search
CPC ..... F01N 13/10; F01N 13/1888; F01N 1/08; F01N 2240/20; F01N 2470/30;
(Continued)

(56) References Cited

U.S. PATENT DOCUMENTS 1,169,030 A * 1/1916 Hardy ..... F01N 1/08 181/255
1,294,475 A * 2/1919 Kirkham ..... F01N 13/08 181/240
(Continued)

FOREIGN PATENT DOCUMENTS

CN 101048581 A 10/2007
CN 101158303 A 4/2008
(Continued)

OTHER PUBLICATIONS

International Search Report in International Application No. PCT/US2015/046036, dated Oct. 16, 2015, 5 pages.
(Continued)

*Primary Examiner* — Minh Le
(74) *Attorney, Agent, or Firm* — Raggio & Dinnin, P.C.; Kurt L. VanVoorhies

(57) ABSTRACT

A fluid-conduit collector (20, 20.*x*, 20$^{a}$, 20$^{b}$) spans across a plurality of collector-inlet interface structures (24, 24.1, 24.2, 24.3, 24', 24") and at least one fluidic diode element (26, 26.1, 26.2, 26.3, 26', 26"). A branch inlet portion (20''', 20.1''', 20.2''', 20.3''') of at least one collector-inlet interface structure (24, 24.1, 24.2, 24.3, 24', 24"), in fluid communication with a corresponding fluid-conduit runner portion (14, 14.*x*), provides for receiving fluid from a source of fluid (12). A main inlet portion (20.*x*') of the collector-inlet interface structure in fluid communication with an outlet portion (20.*x*") thereof defines a portion of the fluid conduit of the collector (20, 20.*x*, 20$^{a}$, 20$^{b}$). The branch inlet portion (20''', 20.1''', 20.2''', 20.3''') is in fluid communication with
(Continued)

the outlet portion (20.*x*") via a collector inlet port (56', 106) that is at least partially bounded by a relatively-sharp-edged junction (60) with the fluid conduit of the collector (20, 20.*x*, 20$^a$, 20$^b$). The fluidic-diode element (26, 26.1, 26.2, 26.3, 26', 26") located coincident with, or downstream of, the collector inlet port (56', 106) provides for a relatively-higher coefficient of discharge for fluid flowing (34, 64) towards (36) an outlet (38) of the collector (20, 20.*x*, 20$^a$, 20$^b$), than for fluid flowing (32) in a reverse direction (40).

40 Claims, 9 Drawing Sheets

(51) Int. Cl.
*F01N 13/18* (2010.01)
*F01N 1/08* (2006.01)

(52) U.S. Cl.
CPC ..... *F01N 2240/20* (2013.01); *F01N 2260/06* (2013.01); *F01N 2260/16* (2013.01); *F01N 2470/18* (2013.01); *F01N 2470/30* (2013.01)

(58) Field of Classification Search
CPC ..... F01N 2470/18; F01N 2260/06; F01N 2260/16; Y10T 137/206; Y10T 137/2087; Y10T 137/2093; Y10T 137/212
USPC ..... 137/803, 808, 809, 814
See application file for complete search history.

(56) References Cited

U.S. PATENT DOCUMENTS 1,327,311 A * 1/1920 Chesnutt ..... F01N 13/10 123/184.38
1,329,559 A 2/1920 Tesla
1,382,285 A 6/1921 Harris
1,760,924 A 6/1930 Watkins
1,775,511 A * 9/1930 Chapman ..... F01N 13/10 181/240
1,947,987 A 2/1934 Hathorn
2,230,666 A * 2/1941 Martin ..... F01N 13/10 60/323
2,274,599 A * 2/1942 Freeman ..... F01N 1/003 181/255
2,455,493 A * 12/1948 Jacobs ..... F01N 3/046 285/124.1
2,612,749 A 10/1952 Tenney et al.
2,730,188 A * 1/1956 Bailey ..... F01N 1/00 181/255
3,064,680 A 11/1962 Winslow, Jr.
3,068,638 A * 12/1962 Birmann ..... F01N 13/102 415/163
3,580,233 A 5/1971 Busse
3,981,770 A * 9/1976 Middleton ..... G21C 15/18 137/888
4,288,988 A * 9/1981 Curtil ..... F01D 9/06 60/605.1
5,188,868 A * 2/1993 Horii ..... B01J 2/006 118/303
5,331,930 A * 7/1994 McWhorter ..... F01L 1/28 123/549
5,892,293 A 4/1999 Lucas
6,170,528 B1 * 1/2001 Junier ..... F01N 1/083 138/37
7,171,805 B2 * 2/2007 Ruehle ..... F01N 13/10 60/313
7,832,205 B2 * 11/2010 Ruehle ..... F01N 13/10 60/323
8,037,620 B2 * 10/2011 Grobler ..... F23C 15/00 34/365
8,365,699 B2 2/2013 Shkolnik et al.
9,169,855 B1 * 10/2015 Dyson ..... F15C 5/00
9,309,904 B2 * 4/2016 Loringer ..... F01N 13/1811
9,745,885 B2 * 8/2017 Geminn ..... F01N 13/10
2004/0079079 A1 * 4/2004 Martin ..... F01N 3/005 60/605.2
2007/0289809 A1 12/2007 Kim
2010/0018192 A1 * 1/2010 Suschik ..... F01N 13/10 60/323
2011/0047997 A1 3/2011 Goplen et al.
2016/0341084 A1 * 11/2016 Nielsen ..... F01N 13/009
2017/0162280 A1 * 6/2017 Loewen ..... F04B 17/00

FOREIGN PATENT DOCUMENTS

CN 101688461 A 3/2010
CN 101158303 B 8/2012
CN 101688461 B 6/2013
EP 0435426 A2 7/1991
EP 0435426 A3 7/1991
GB 189676 A * 12/1922 ..... F01N 1/06
GB 522861 A 6/1940
JP S63262339 A 10/1988
JP 2012052450 A 3/2012
KR 20090108578 A 10/2009

OTHER PUBLICATIONS

Written Opinion of the International Searching Authority in International Application No. PCT/US2015/046036, dated Oct. 16, 2015, 6 pages.
Communication pursuant to Article 94(3) EPC in counterpart European Application No. 15757105.0, dated Feb. 6, 2018, 6 pages.
China National Intellectual Property Administration Search Report in Chinese Application No. 201580044666.X dated Aug. 20, 2015, 6 pp. English and Chinese.
China National Intellectual Property Administration, First Office Action in Chinese Application No. 201580044666.X dated Aug. 20, 2015, 12 pp. English and Chinese.

* cited by examiner

VALVULAR-CONDUIT MANIFOLD

CROSS-REFERENCE TO RELATED APPLICATIONS

The instant application claims the benefit of prior U.S. Provisional Application Ser. No. 62/040,258 filed on 21 Aug. 2014, which is incorporated herein by reference.

DESCRIPTION OF EMBODIMENT(S)

Figure 1:
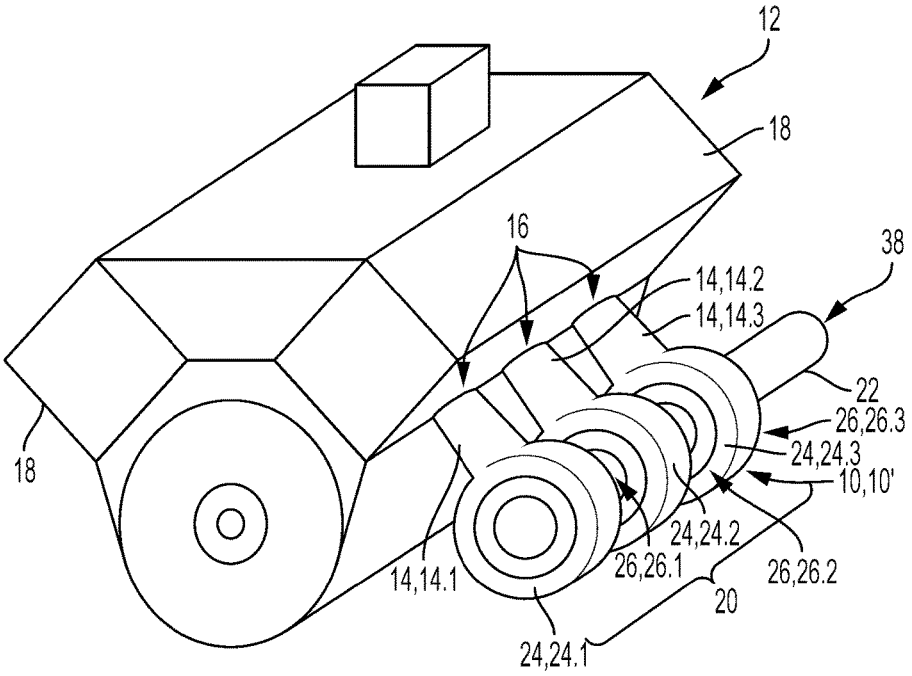
FIG. 1 illustrates an isometric view of an internal combustion engine incorporating a valvular-conduit exhaust manifold.

Referring to FIG. 1, a valvular-conduit exhaust manifold 10 incorporated in an intermittent-combustion internal combustion engine 12 comprises a plurality of fluid-conduit runners 14, each in fluid communication with a corresponding exhaust port 16 of an associated cylinder head 18 of the internal combustion engine 12, each of which fluid-conduit runners 14 is in fluid communication with an associated collector 20 of the valvular-conduit exhaust manifold 10, the latter of which is a fluid conduit that collects the exhaust gases from each of the fluid-conduit runners 14 and provides for discharging the collected exhaust gases through an associated outlet exhaust pipe 22 for ultimate discharge therefrom.

The intermittent-combustion internal combustion engine 12 operates in accordance with an associated thermodynamic cycle, for example, including but not limited to, either reciprocating engines having either two, four or six strokes per cycle operating under either an Otto cycle, a Diesel cycle, an Atkinson cycle, or a Miller cycle, or a rotary engine, for example, a Wankel engine or rotary Atkinson cycle engine, so that each cylinder inherently generates an associated pulsating exhaust flow that induces pulsating bulk flow or acoustic pressure waves in the associated exhaust conduit—i.e. each associated fluid-conduit runner 14 and the collector 20—operatively connected thereto. More particularly, for a particular cylinder, during the exhaust phase of the thermodynamic cycle, exhaust gases are discharged from the exhaust port 16 of the cylinder head 18 into the corresponding fluid-conduit runner 14 of the valvular-conduit exhaust manifold 10, and the inherent pulsating nature of the exhaust flow results in a corresponding bulk flow or acoustic pressure wave therein having a direction of flow away from the cylinder head 18. Thereafter, after the end of the exhaust phase of the thermodynamic cycle, i.e. following closure of the associated exhaust valve, the bulk flow or acoustic pressure wave eventually reflects at a relatively-downstream location, resulting in a reflected, reverse-directed bulk flow or acoustic pressure wave propagating in the opposite direction to the primary exhaust flow. The valvular-conduit exhaust manifold 10 provides for mitigating against, or attenuating, this reverse-directed bulk flow or acoustic pressure wave, which otherwise could act to relatively impede the primary flow of exhaust gases from the engine through the runners and into through the collector of the associated exhaust manifold.

Figure 2:
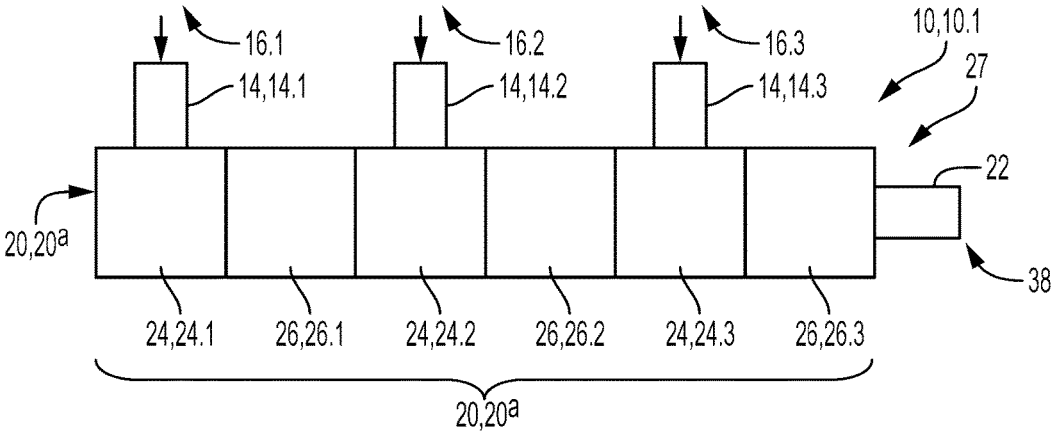
FIG. 2 illustrates a schematic diagram of a first aspect of a valvular-conduit exhaust manifold.

Referring to FIG. 2, in accordance with a first aspect of the valvular-conduit exhaust manifold 10, 10.1, each fluid-conduit runner 14, 14.1, 14.2, 14.3 is operatively coupled to the collector 20, 20$^a$ of the valvular-conduit exhaust manifold 10, 10.1 via a corresponding associated collector-inlet interface structure 24, 24.1, 24.2, 24.3 that provides for directing the exhaust gases from the fluid-conduit runner 14 into the collector 20, 20$^a$ in a direction generally towards the outlet 38 thereof. A corresponding associated fluidic-diode element 26, 26.1, 26.2, 26.3 is located downstream—relative to the primary direction of exhaust flow—of each collector-inlet interface structure 24, 24.1, 24.2, 24.3 so as to provide for impeding a backflow of an associated reverse-directed bulk flow or acoustic pressure wave. More particularly, for the three-cylinder valvular-conduit exhaust manifold 10 illustrated in FIGS. 1 and 2, a first fluidic-diode element 26, 26.1 is located downstream of a corresponding associated first collector-inlet interface structure 24, 24.1 that receives exhaust gases from a corresponding first exhaust port 16, 16.1 of the cylinder head 18, a second fluidic-diode element 26, 26.2 is located downstream of a corresponding associated second collector-inlet interface structure 24, 24.2 that receives exhaust gases from a corresponding second exhaust port 16, 16.2 of the cylinder head 18, and a third fluidic-diode element 26, 26.3 is located downstream of a corresponding associated third collector-inlet interface structure 24, 24.3 that receives exhaust gases from a corresponding third exhaust port 16, 16.3 of the cylinder head 18, wherein the second collector-inlet interface structure 24, 24.2 is downstream of the first fluidic-diode element 26, 26.1, the third collector-inlet interface structure 24, 24.3 is downstream of the second fluidic-diode element 26, 26.2, the outlet exhaust pipe 22 of the valvular-conduit exhaust manifold 10 is downstream of the third fluidic-diode element 26, 26.3, and the collector 20, 20$^a$ of the valvular-conduit exhaust manifold 10 extends from the first collector-inlet interface structure 24, 24.1 to the third fluidic-diode element 26, 26.3. As used herein, the term "fluidic-diode element" is intended to mean a fluid conduit structure for which the coefficient of discharge is substantially greater for fluid flow therethrough in one direction than for fluid flow therethrough in the opposite direction, wherein the coefficient of discharge is defined as the ratio of the effective hydraulic diameter of a fluid conduit to the corresponding actual hydraulic diameter, with the effective hydraulic diameter being defined as the hydraulic diameter of a corresponding straight fluid conduit having the same resistance to flow. Also as used herein, the term "valvular conduit" is intended to mean a fluid conduit structure that incorporates a fluidic-diode element along the length thereof. Accordingly, the collector 20, 20$^a$ of the valvular-conduit exhaust manifold 10 constitutes a valvular conduit 27. The fluidic-diode elements 26, 26.1, 26.2, 26.3 as used in the valvular-conduit exhaust manifold 10 are configured so that the exhaust flow in a forward direction out of the collector 20, 20$^a$ benefits from the relatively-higher coefficient of discharge; whereas the corresponding reverse flow therein is subject to the relatively-lower coefficient of discharge, so as to provide for attenuating the reverse-directed bulk flow or acoustic pressure wave of exhaust gases—also referred to herein as "backflow"—within the collector 20, 20$^a$. Accordingly, the third fluidic-diode element 26, 26.3 provides for mitigating against the reverse-directed bulk flow or acoustic pressure wave upstream thereof, either back into the collector 20, 20$^a$, or into the third fluid-conduit runner 14, 14.3, the second fluidic-diode element 26, 26.2 provides for mitigating against the reverse-directed bulk flow or acoustic pressure wave upstream thereof, either back into the collector 20, 20$^a$, or into the second fluid-conduit runner 14, 14.2, and the first fluidic-diode element 26, 26.1 provides for mitigating against the reverse-directed bulk flow or acoustic pressure wave upstream thereof into the first fluid-conduit runner 14, 14.1.

Figure 3A:
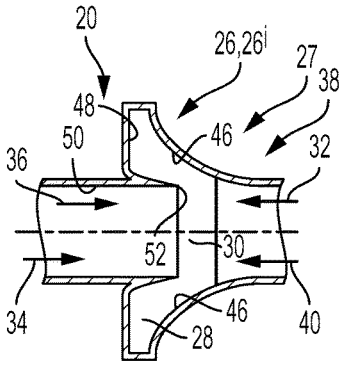
FIG. 3*a* illustrates a fragmentary longitudinal cross-sectional view of a first embodiment of a fluidic-diode element within a valvular conduit.
Figure 3B:
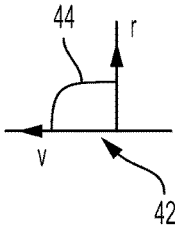
FIG. 3*b* illustrates a velocity profile of a reverse-directed bulk flow flowing in the valvular conduit illustrated in FIG. 3*a;*

Referring to FIG. 3*a*, in accordance with a first embodiment, the fluidic-diode element 26, 26$^i$—a portion of the collector 20—comprises an annular cavity 28 at least partially circumscribing a longitudinal portion of the collector 20 and in fluid communication therewith via an associated orifice 30 through and along what would otherwise be the wall of the collector 20, which provides for mitigating against the reverse-directed bulk flow or acoustic pressure wave 32, for example, by the attenuation thereof as a result of either absorption or re-reflection back onto the reverse-directed bulk flow or acoustic pressure wave 32. More particularly, the forward-directed bulk flow or acoustic pressure wave 34—wherein the forward direction is the direction of the primary exhaust flow—resulting from the discharge of exhaust gases from the exhaust port 16 of the cylinder head 18, flows relatively unimpeded in a first direction 36 (i.e. the "forward direction") towards the outlet 38 of the collector 20 of the valvular-conduit exhaust manifold 10. However, the reverse-directed bulk flow or acoustic pressure wave 32 flowing in a second direction 40 (i.e. the "reverse direction"), opposite to the first direction 36,—for example, having a velocity profile 42 as illustrated in FIG. 3*b*,—upon interacting with the fluidic-diode element 26, 26$^i$, will become impeded thereby as a result of the boundary layer portion 44 of the reverse-directed bulk flow or acoustic pressure wave 32 attaching to the outer wall portion 46 of the annular cavity 28 and thereafter being directed into the annular cavity 28, resulting in either at least partial attenuation or reflection thereof, so that the fluidic-diode element 26, 26$^i$ acts to at least partially impede reverse-directed bulk flow or acoustic pressure wave 32 within the collector 20. The annular cavity 28 acts to diffuse the reverse-directed bulk flow or acoustic pressure wave 32 that interacts therewith as a result of a positive gradient of area with respect to propagation distance along the reflected path in generally the second direction 40, whereby the velocity of the reverse-directed bulk flow or acoustic pressure wave 32 decreases as the flow area increases in accordance with the principle of conservation of momentum. For example, in one set of embodiments, the annular cavity 28 is shaped—for example, generally bell-shaped, for example, as illustrated in FIG. 3*a*—so as to overly-aggressively diffuse the reverse-directed bulk flow or acoustic pressure wave 32, relative to a more efficient diffuser, so that the associated pressure gradient along the reflected path in generally the second direction 40 is sufficiently great so as to cause the previously wall-attached flow to separate from the wall, resulting in associated eddies and flow reversal, so that at least a portion of the reverse-directed bulk flow or acoustic pressure wave 32 is redirected in the first direction 36, thereby impeding other reverse-directed bulk flow or acoustic pressure waves 32 flowing in the second direction 40. Furthermore, the upstream wall 48 of the annular cavity 28 intersects the wall 50 of the collector 20 at a transverse peripherally-extending (e.g. circumferentially extending) sharp-edge junction 52 that provides for inducing, or shedding, vortices that act to further impede reverse-directed bulk flow or acoustic pressure waves 32 attempting to flow upstream therefrom into the collector 20.

Figure 4:
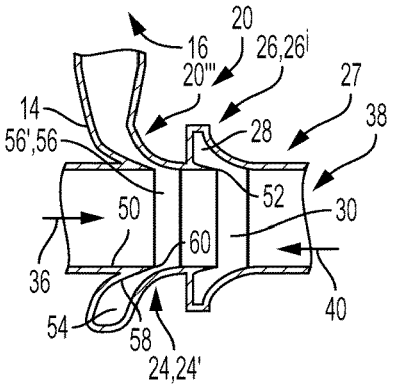
FIG. 4 illustrates a fragmentary longitudinal cross-sectional view of a portion of a valvular-conduit exhaust manifold incorporating a first aspect of a collector-inlet interface structure in cooperation with a fluidic-diode element within a valvular-conduit collector, with the associated cutting plane passing through an associated fluid-conduit runner portion of the collector-inlet interface structure.

Referring to FIG. 4, the above-described fluidic-diode element 26, 26$^i$ is illustrated in cooperation with a first aspect of a collector-inlet interface structure 24, 24', the former of which is located downstream of the latter within the collector 20 so as to provide for mitigating against, or attenuating, reverse-directed bulk flow or acoustic pressure waves 32 flowing upstream thereof, either into the associated fluid-conduit runner 14, or further upstream of the collector-inlet interface structure 24, 24' into the collector 20. In accordance with the first aspect, the collector-inlet interface structure 24, 24' incorporates a branch inlet portion 20''' comprising an annular fluid conduit 54 at least partially circumscribing a longitudinally-extending portion of the collector 20 and in fluid communication therewith via an associated collector inlet port 56' comprising at least partially circumscribing orifice 56 through and along what would otherwise be the wall of the collector 20. The annular fluid conduit 54 is also in fluid communication with an associated fluid-conduit runner 14, which is in turn in fluid communication with an associated exhaust port 16 of the intermittent-combustion internal combustion engine 12, and which provides for delivering exhaust gases therefrom to the annular fluid conduit 54. Exhaust gases are then discharged from the annular fluid conduit 54 into the collector 20 via the associated orifice 56 of the associated collector inlet port 56', generally radially inwards in all directions from the periphery of the collector 20. The upstream wall 58 of the annular fluid conduit 54 intersects the wall 50 of the collector 20 at a transverse peripherally-extending (e.g. circumferentially extending) sharp-edge junction 60 that provides for inducing vortices that act to impede reverse-directed bulk flow or acoustic pressure waves 32 attempting to flow upstream therefrom either into the annular fluid conduit 54, or upstream therefrom into the collector 20. Accordingly, the fluid-conduit runner 14 is operatively coupled to the annular fluid conduit 54 with a smooth, converging flow path that terminates with a sharp-edge junction 60, the latter of which opposes flow in the reverse direction. Furthermore, relative to a reverse-directed bulk flow or acoustic pressure wave 32 that might enter the annular fluid conduit 54, the annular fluid conduit 54 acts similar to the annular cavity 28 of the fluidic-diode element 26, 26$^i$ to redirect at least a portion of the reverse-directed bulk flow or acoustic pressure wave 32 out of the annular fluid conduit 54 and back into the collector 20 via the associated orifice 56 of the associated collector inlet port 56'.

Figure 5:
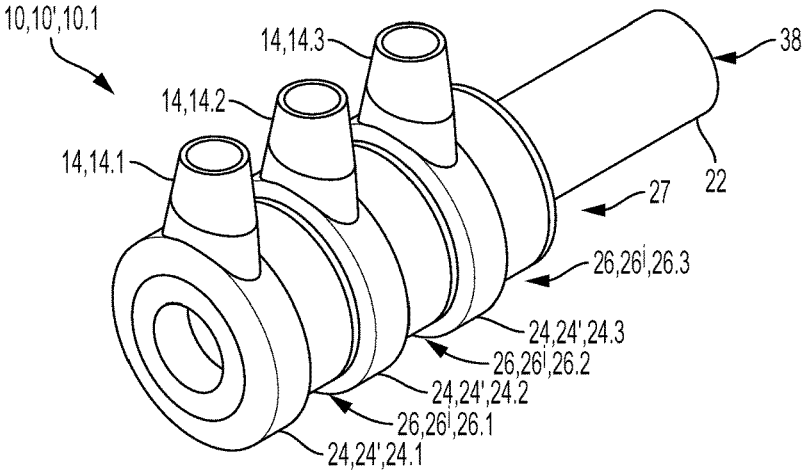
FIG. 5 illustrates an isometric view of the valvular-conduit exhaust manifold illustrated in FIG. 1.
Figure 6:
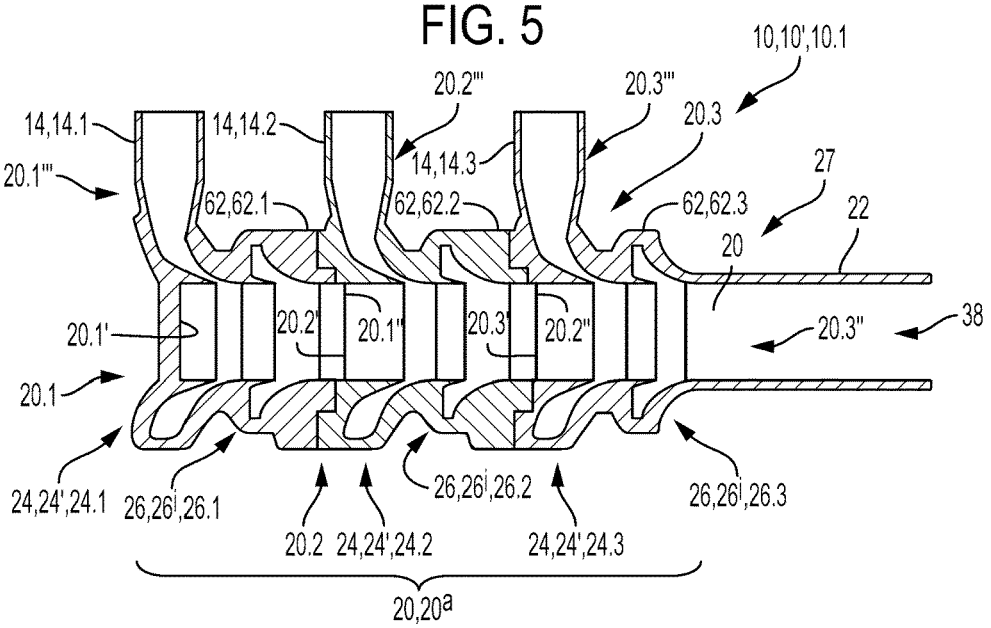
FIG. 6 illustrates a longitudinal cross-sectional view of the valvular-conduit exhaust manifold illustrated in FIG. 5, with the associated cutting plane passing through associated fluid-conduit runner portions of the associated collector-inlet interface structures.

Referring to FIGS. 5 and 6, respectively illustrating isometric and longitudinal cross-sectional views of the first embodiment of the valvular-conduit exhaust manifold 10, 10.1, 10' illustrated in FIG. 1, the valvular-conduit exhaust manifold 10 comprises a plurality of collector-inlet interface structures 24, 24', 24.1, 24.2, 24.3 paired with corresponding associated fluidic-diode elements 26, 26$^i$, 26.1, 26.2, 26.3—for example, each pair as illustrated in FIG. 4—each in fluid communication with a corresponding different exhaust port 16, 16.1, 16.2, 16.3 of the intermittent-combustion internal combustion engine 12 via an associated fluid-conduit runner 14, 14.1, 14.2, 14.3 in fluid communication with an associated branch inlet portion 20.1''', 20.2''', 20.3''', as described hereinabove, wherein the central fluid conduit portions of each collector-inlet interface structure 24 and each fluidic-diode element 26, 26$^i$ collectively constitute a portion of the collector 20. In accordance with the first embodiment, the valvular-conduit exhaust manifold 10, 10' comprises a plurality of valvular-conduit exhaust manifold elements 62, 62.1, 62.2, 62.3—each comprising a unitary combination of a collector-inlet interface structure 24, 24' and an associated fluidic-diode element 26, 26$^i$—that are assembled together to form the associated valvular-conduit exhaust manifold 10, 10.1 as a segmented structure comprising a combination of associated collector portions 20.1, 20.2, 20.3 that abut one another, each having a main inlet portion 20.1', 20.2', 20.3' and an outlet portion 20.1", 20.2", 20.3", but with the first main inlet portion 20.1' blocked, wherein the outlet portion 20.1" of the first collector portion 20.1 of the first valvular-conduit exhaust manifold element 62, 62.1 is operatively coupled to the main inlet portion 20.2' of the second collector portion 20.2 of the second valvular-conduit exhaust manifold element 62, 62.2, the outlet portion 20.2" of the second collector portion 20.2 of the second valvular-conduit exhaust manifold element 62, 62.2 is operatively coupled to the main inlet portion 20.3' of the third collector portion 20.3 of the third valvular-conduit exhaust manifold element 62, 62.3, and the outlet portion 20.3" of the third collector portion 20.3 of the third valvular-conduit exhaust manifold element 62, 62.3 is operatively coupled to the outlet exhaust pipe 22.

Figure 7:
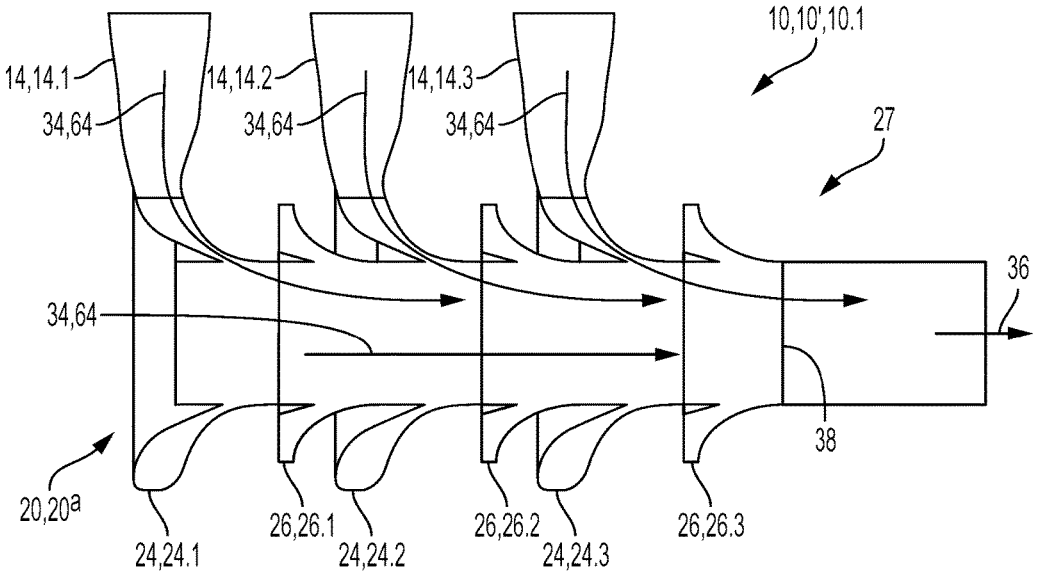
FIG. 7 illustrates the operation of the valvular-conduit exhaust manifold illustrated in FIGS. 5 and 6 for a composite of different points in time when exhaust gases are flowing out of each of the runners of the exhaust manifold.
Figure 8:
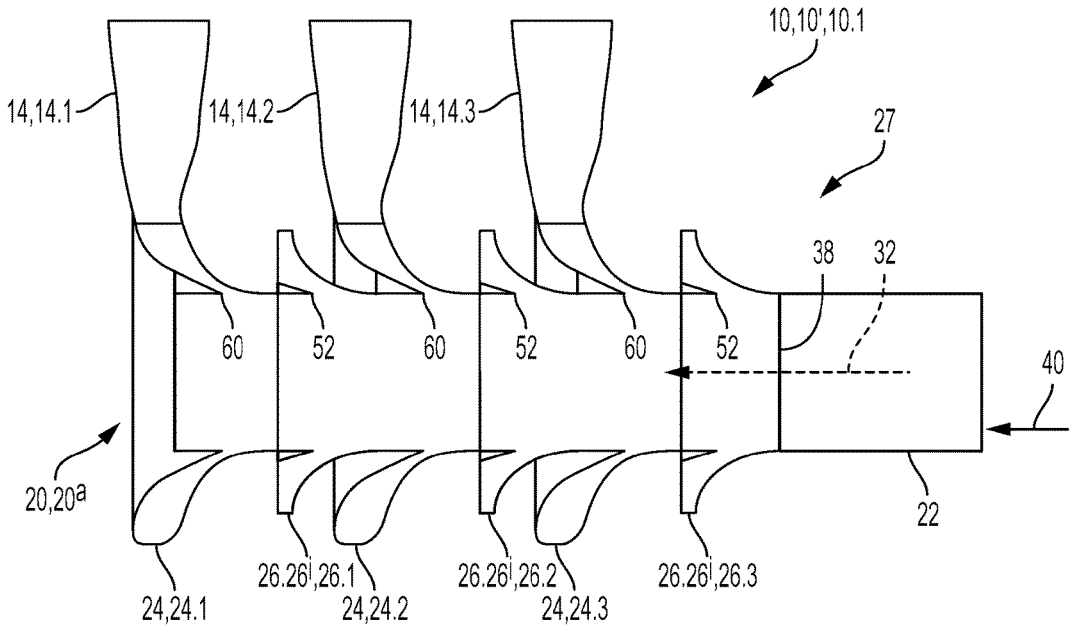
FIG. 8 illustrates the operation of the valvular-conduit exhaust manifold illustrated in FIGS. 5 and 6 for a composite of different points in time when a bulk flow or acoustic pressure wave is flowing back into the valvular conduit from the outlet.

FIG. 7 illustrates the flow of exhaust gases 64 out of the fluid-conduit runners 14, 14.1, 14.2, 14.3 and the collector 20 of the valvular-conduit exhaust manifold 10, 10.1, 10' illustrated in FIGS. 5 and 6, during the exhaust phases of the associated cylinders of the associated intermittent-combustion internal combustion engine 12, illustrating by the number and line style of the associated arrows, a relatively-unobstructed flow of the forward-directed bulk flow or acoustic pressure wave 34 in the first direction 36 through the valvular-conduit exhaust manifold 10, 10.1, 10'. By comparison, FIG. 8 illustrates a relatively-attenuated flow of the reverse-directed bulk flow or acoustic pressure wave 32 in the second direction 40 within the collector 20 of the valvular-conduit exhaust manifold 10, 10.1, 10' during other phases of the associated cylinders of the associated intermittent-combustion internal combustion engine 12 when the associated exhaust valves are closed, illustrating the effects of the associated fluidic-diode elements 26, 26$^{i}$, 26.1, 26.2, 26.3, the associated sharp-edge junctions 52, 60, and the geometry of the associated collector-inlet interface structures 24, 24.1, 24.2, 24.3.

It should be understood that alternatively, two or more adjacent valvular-conduit exhaust manifold elements 62, 62.1, 62.2, 62.3 could be integrated in a unitary structure, and need not necessarily be segmented as illustrated herein. For example, all of the valvular-conduit exhaust manifold elements 62, 62.1, 62.2, 62.3 could be integrated as a single, unitary exhaust manifold, which, for example, could be formed by either casting or additive manufacturing.

Figure 9A:
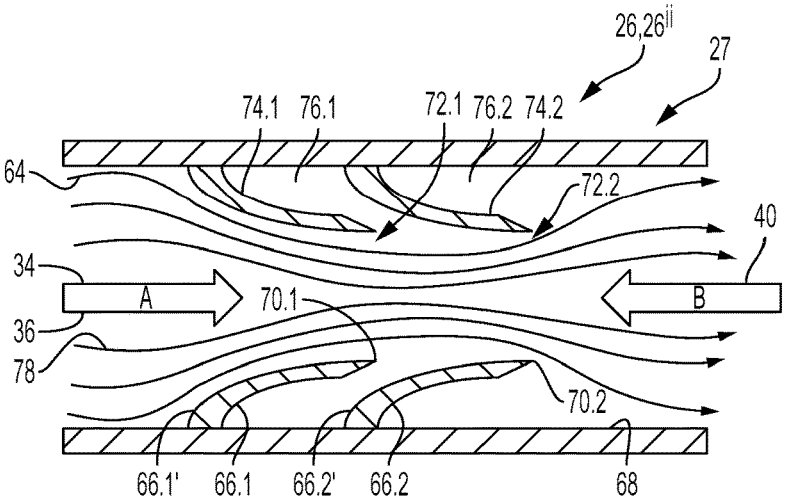
FIG. 9*a* illustrates a longitudinal cross-sectional view of a second embodiment of a fluidic-diode element within a valvular conduit, including flow lines associated with a forward-directed bulk flow or acoustic pressure wave.
Figure 9B:
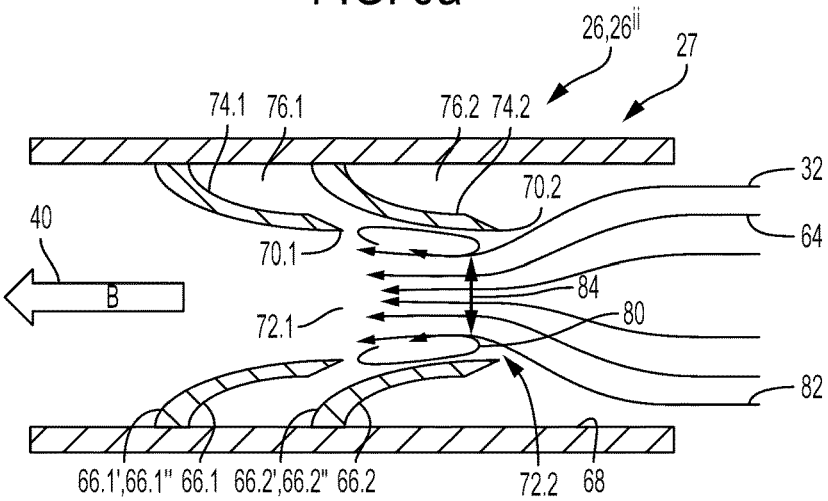
FIG. 9*b* illustrates a longitudinal cross-sectional view of the second embodiment of a fluidic-diode element illustrated in FIG. 9*a*, with flow lines illustrating a vena contracta effect resulting from the interaction of a reverse-directed bulk flow or acoustic pressure wave with the associated fluid-diode element.
Figure 9C:
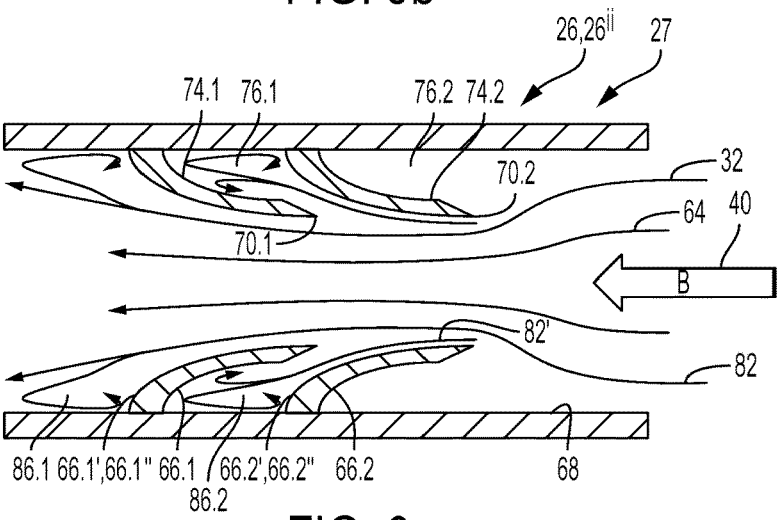
FIG. 9*c* illustrates a longitudinal cross-sectional view of the second embodiment of a fluidic-diode element illustrated in FIG. 9*a*, with flow lines illustrating a separated diffuser effect resulting from the interaction of a reverse-directed bulk flow or acoustic pressure wave with the associated fluid-diode element.

Referring to FIGS. 9*a*-9*c*, a second embodiment of a fluidic-diode element 26, 26$^{ii}$ comprises first 66.1' and second 66.2' converging surfaces, each on the inside of corresponding respective associated first 66.1 and second 66.2 nozzle shell elements that are axially separated from one another within a fluid conduit 68, and partially nested with respect to one another—i.e. wherein the base of the second nozzle shell element 66, 66.2 is located upstream of a first sharp edge 70, 70.1 of a first nozzle shell element 66, 66.1,—wherein the first 66.1' and second 66.2' converging surfaces converge relative to flow in the first direction 36. Each of the first 66.1' and second 66.2' converging surfaces terminate at respective associated transverse, peripherally-extending (e.g. circumferentially extending) sharp edges 70, 70.1, 70.2 that at least partially circumscribe corresponding respective associated throats 72.1, 72.2. The respective exterior surfaces 74.1, 74.2 of the first 66.1 and second 66.2 nozzle shell elements define corresponding respective annular cavities 76.1, 76.2 within the fluid conduit 68.

FIGS. 9*a*-*c* illustrate the principal operating mechanisms of the fluidic-diode element 26, 26$^{ii}$ that provide for a relatively-lower resistance to flow in the first direction 36, and a relatively-higher resistance to flow in the opposite, second direction 40. The flow of exhaust gases 64 in the first direction 36 principally follows a set of converging-diverging flow paths 78 illustrated in FIG. 9*a* that are subject to an abrupt expansion downstream of the second throat 72.2, resulting in an associated relatively-high discharge coefficient, indicative of relatively low associated losses. However, a reverse-directed bulk flow or acoustic pressure wave 32 upon interacting with the fluidic-diode element 26, 26$^{ii}$ initially encounters the second sharp edge 70, 70.2 of the second nozzle shell element 66, 66.2 which results in a relatively-low discharge coefficient—indicative of relatively high associated losses—as a result a vena-contracta mechanism illustrated FIG. 9*b*, and as a result of an overly-aggressive-diffuser mechanism illustrated in FIG. 9*c*. In accordance with the vena-contracta mechanism, the sudden contraction in flow area that occurs when the reverse-directed bulk flow or acoustic pressure wave 32 encounters the second throat 72.2, and the effect of the associated second sharp edge 70, 70.2, cause an associated eddy flow 80 downstream (relative to the reverse-directed bulk flow or acoustic pressure wave 32) of the second sharp edge 70, 70.2, which causes the associated backflow flow paths 82 to become constricted within an effective throat area 84 that is substantially smaller than that actual area of the second throat 72.2. Relative to the reverse-directed bulk flow or acoustic pressure wave 32 flowing along associated backflow flow paths 82, the first 66.1' and second 66.2' converging surfaces act as first 66.1" and second 66.2" diverging surfaces In accordance with the overly-aggressive-diffuser mechanism—that was also described hereinabove—portions 82' of the reverse-directed bulk flow or acoustic pressure wave 32 attach to the first 66.1" and second 66.2" diverging surfaces, and become diffused as a result of the associated geometric expansion of the flow area, wherein the rate of expansion is sufficiently great so as to cause the pressure to increase at a rate that is greater than compatible with continued attachment to the first 66.1" or second 66.2" diverging surfaces, causing those affected portions 82' of the reverse-directed bulk flow or acoustic pressure wave 32 to become detached from the first 66.1" or second 66.2" diverging surfaces, resulting in eddy flow and associated flow reversals in the regions 86.1, 86.2 downstream (relative to the reverse-directed bulk flow or acoustic pressure wave 32) of the first 66.1" and second 66.2" diverging surfaces, which act against the reverse-directed bulk flow or acoustic pressure wave 32.

Figure 10:
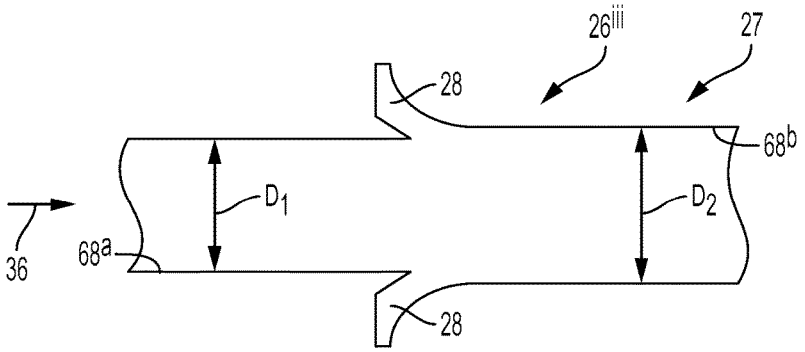
FIG. 10 illustrates a longitudinal cross-sectional view of a third embodiment of a fluidic-diode element within a valvular conduit.
Figure 11:
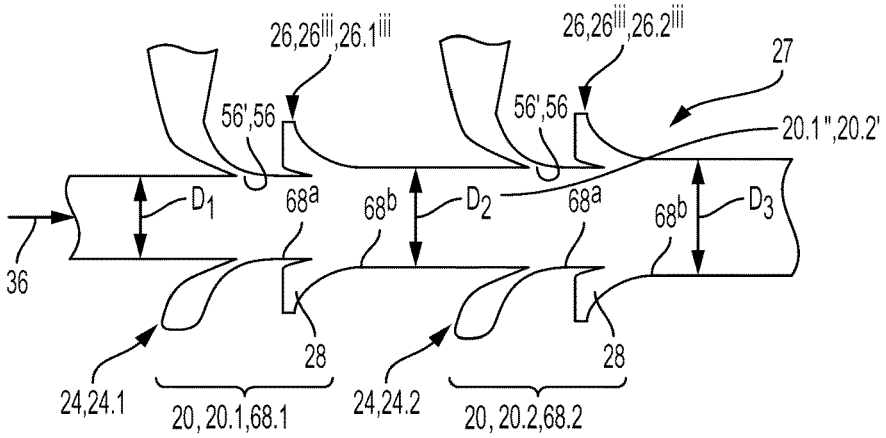
FIG. 11 illustrates a longitudinal cross-sectional view of a portion of a valvular-conduit exhaust manifold incorporating the third embodiment of the fluidic-diode element illustrated in FIG. 10.

Referring to FIG. 10, a third embodiment of a fluidic-diode element 26, 26$^{iii}$ is otherwise similar to the first embodiment illustrated in FIG. 3 except that, relative to the forward-directed bulk flow or acoustic pressure wave 34 flowing in the first direction 36, the inside diameter $D_2$ of a second portion 68$^{b}$ of the fluid conduit 68 downstream of the annular cavity 28 is greater than the inside diameter $D_1$ of a first portion 68$^{a}$ of the fluid conduit 68 upstream of the annular cavity 28, so as to enhance the effect of the annular cavity 28 on the reverse-directed bulk flow or acoustic pressure wave 32. Referring to FIG. 11, the third embodiment of the fluidic-diode element 26, 26$^{iii}$, 26.1$^{iii}$, 26.2$^{iii}$ is incorporated in each of two successive collector portions 20.1, 20.2, each also incorporating an associated collector-inlet interface structure 24, 24.1, 24.2 upstream of the associated fluidic-diode element 26, 26$^{iii}$, 26.1$^{iii}$, 26.2$^{iii}$, wherein the inside diameter $D_1$ of the first portion 68$^{a}$ of the first fluid conduit 68.1 of the first collector portion 20.1 is less than the inside diameter $D_2$ of the second portion 68$^{b}$ of the first fluid conduit 68.1, the inside diameter $D_2$ of the first portion 68$^{a}$ of the second fluid conduit 68.2 of the second collector portion 20.2 is less than the inside diameter $D_3$ of the second portion 68$^{b}$ of the second fluid conduit 68.2, and the inside diameter $D_2$ of the main inlet portion 20.2' of the second collector portion 20.2 is equal to the inside diameter $D_2$ of the outlet portion 20.1" of the first collector portion 20.1, so that the flow area of the associated collector 20 increases along the first direction 36 of flow of the forward-directed bulk flow or acoustic pressure wave 34, so as to provide for accommodating an increased flow rate within the collector 20 from the additional contribution of additional fluid-conduit runners 14 joined thereto at successive downstream locations.

Figure 12:
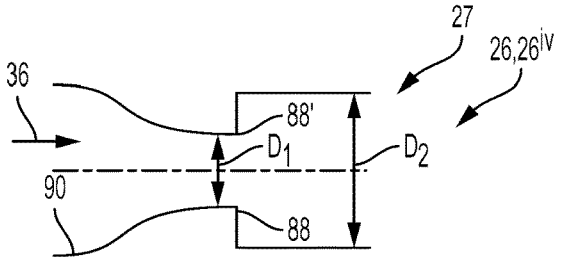
FIG. 12 illustrates a longitudinal cross-sectional view of a fourth embodiment of a fluidic-diode element within a valvular conduit.
Figure 13:
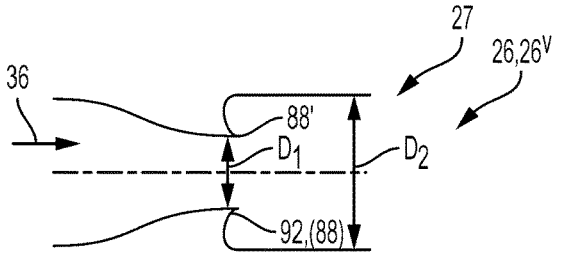
FIG. 13 illustrates a longitudinal cross-sectional view of a fifth embodiment of a fluidic-diode element within a valvular conduit.

Referring to FIG. 12, a fourth embodiment of a fluidic-diode element 26, 26$^{iv}$ comprises a transverse peripherally-extending (e.g. circumferentially extending) sharp-edged step 88 with an associated stepped increase in diameter along the first direction 36 of flow of the forward-directed bulk flow or acoustic pressure wave 34, either preceded by a smoothly converging flowpath 90 as illustrated, or, alternatively, by a fluid-conduit portion of uniform flow area. Referring to FIG. 13, a fifth embodiment of a fluidic-diode element 26, 26$^{v}$ is similar to the fourth embodiment, except that the face 92 of the sharp-edged step 88 is hollowed out so as to enhance the effect of the associated sharp edge 88'.

Figure 14:
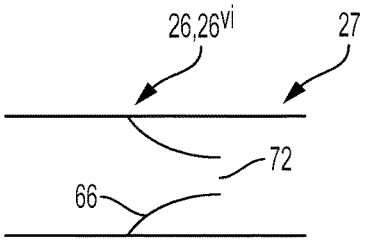
FIG. 14 illustrates a longitudinal cross-sectional view of a sixth embodiment of a fluidic-diode element within a valvular conduit.
Figure 15:
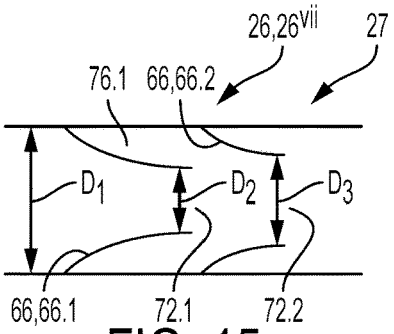
FIG. 15 illustrates a longitudinal cross-sectional view of a seventh embodiment of a fluidic-diode element within a valvular conduit.

Referring to FIG. 14, a sixth embodiment of a fluidic-diode element 26, 26$^{vi}$ is similar to the second embodiment, but incorporates a single associated nozzle shell element 66. It should be understood that the number of distinct nozzle shell elements 66 is not limiting. For example, the fluidic-diode element 26 could alternatively incorporate more than two nozzle shell elements 66, wherein the effects of the separate nozzle shell elements 66 on the nozzle discharge coefficient for a particular direction of flow will multiply as each successive nozzle shell element 66 is added. Furthermore, the inside diameter of the throats 72 of each nozzle shell element 66 need not necessarily be the same (as was illustrated for the second embodiment). For example, referring to FIG. 15, in accordance with a seventh embodiment of a fluidic-diode element 26, 26$^{vii}$, the inside diameter $D_2$ of the throat 72.1 of the relatively-upstream nozzle shell element 66, 66.1 is smaller than the inside diameter $D_3$ of the throat 72.2 of the relatively-downstream nozzle shell element 66, 66.2, so as to provide for enhancing the effect of the annular cavity 76.1 therebetween.

Figure 16:
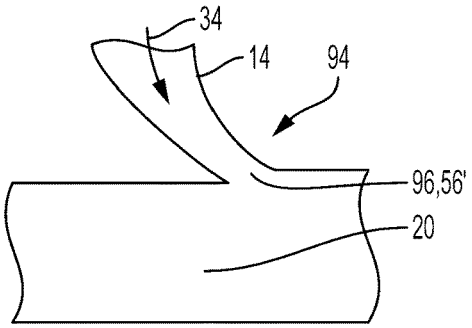
FIG. 16 illustrates a longitudinal cross-sectional view of a second aspect of a collector-inlet interface structure.
Figure 17:
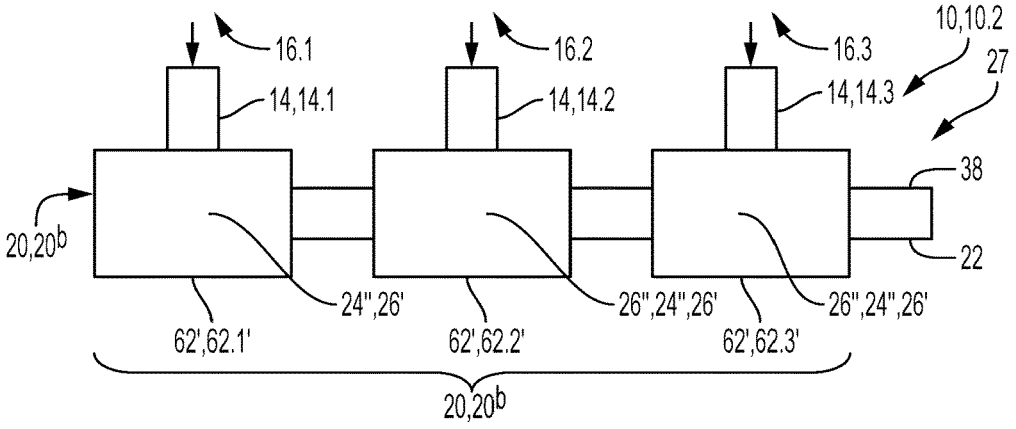
FIG. 17 illustrates a schematic diagram of a second aspect of a valvular-conduit exhaust manifold.

Referring to FIG. 16, in accordance with a second aspect of a collector-inlet interface structure 94 that alternatively may be incorporated in the valvular-conduit exhaust manifold 10, the associated fluid-conduit runner 14 discharges directly into the collector 20 via the associated collector inlet port 56' comprising an associated orifice 96 at the end of the fluid-conduit runner 14, without the intervening annular fluid conduit 54 and associated at least partially circumscribing orifice 56 of the first aspect, wherein leading up to the collector 20, the fluid-conduit runner 14 converges in the direction of the forward-directed bulk flow or acoustic pressure wave 34 from the fluid-conduit runner 14.

Referring to FIGS. 17 and 18*a-d*, in accordance with a second aspect of a valvular-conduit exhaust manifold 10, 10.2, fluidic-diode elements 26', 26" are integrated with the associated collector-inlet interface structure 24"—respectively both downstream and upstream thereof, or just downstream thereof for the upstream-most collector-inlet interface structure 24"—associated with each fluid-conduit runner 14 of the valvular-conduit exhaust manifold 10, 10.2, so as to constitute an associated second aspect of a valvular-conduit exhaust manifold element 62'. More particularly, for the three-cylinder valvular-conduit exhaust manifold 10 illustrated in FIGS. 1 and 17, a first valvular-conduit exhaust manifold element 62.1' receives exhaust gases from a corresponding first exhaust port 16, 16.1 of the cylinder head 18 via an associated first fluid-conduit runner 14, 14.1, a second valvular-conduit exhaust manifold element 62.2' receives exhaust gases from a corresponding second exhaust port 16, 16.2 of the cylinder head 18 via an associated second fluid-conduit runner 14, 14.2, and a third valvular-conduit exhaust manifold element 62.3' receives exhaust gases from a corresponding third exhaust port 16, 16.3 of the cylinder head 18 via an associated third fluid-conduit runner 14, 14.3, wherein the second valvular-conduit exhaust manifold element 62.2' is downstream of the first valvular-conduit exhaust manifold element 62.1', the third valvular-conduit exhaust manifold element 62.3' is downstream of the second valvular-conduit exhaust manifold element 62.2', the outlet exhaust pipe 22 of the valvular-conduit exhaust manifold 10, 10.2 is downstream of the third valvular-conduit exhaust manifold element 62.3', and the collector 20, 20$^{b}$ of the valvular-conduit exhaust manifold 10, 10.2 extends from the first valvular-conduit exhaust manifold element 62.1' to the third valvular-conduit exhaust manifold element 62.3'.

Figure 18A:
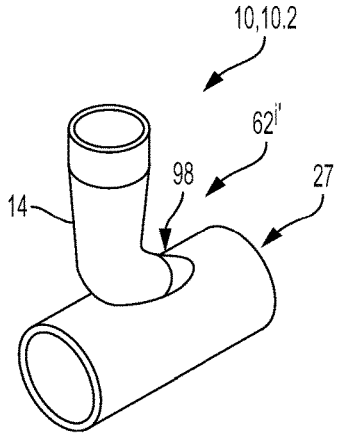
FIG. 18*a* illustrates an isometric view of a first embodiment of a portion of the second aspect of a valvular-conduit exhaust manifold.
Figure 18B:
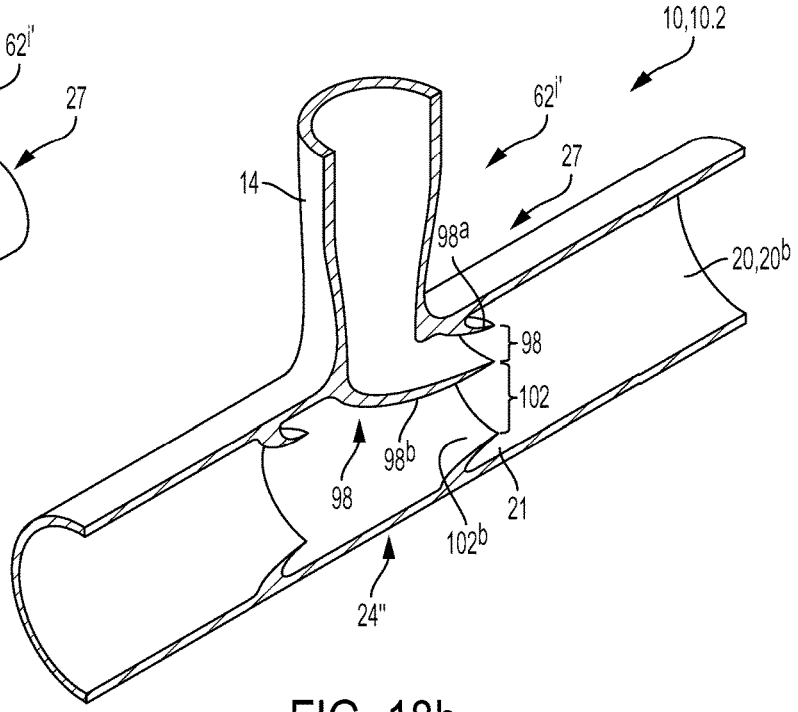
FIG. 18*b* illustrates an isometric cross-sectional view of the first embodiment of the portion of the second aspect of the valvular-conduit exhaust manifold illustrated in FIG. 18*a;*
Figure 18C:
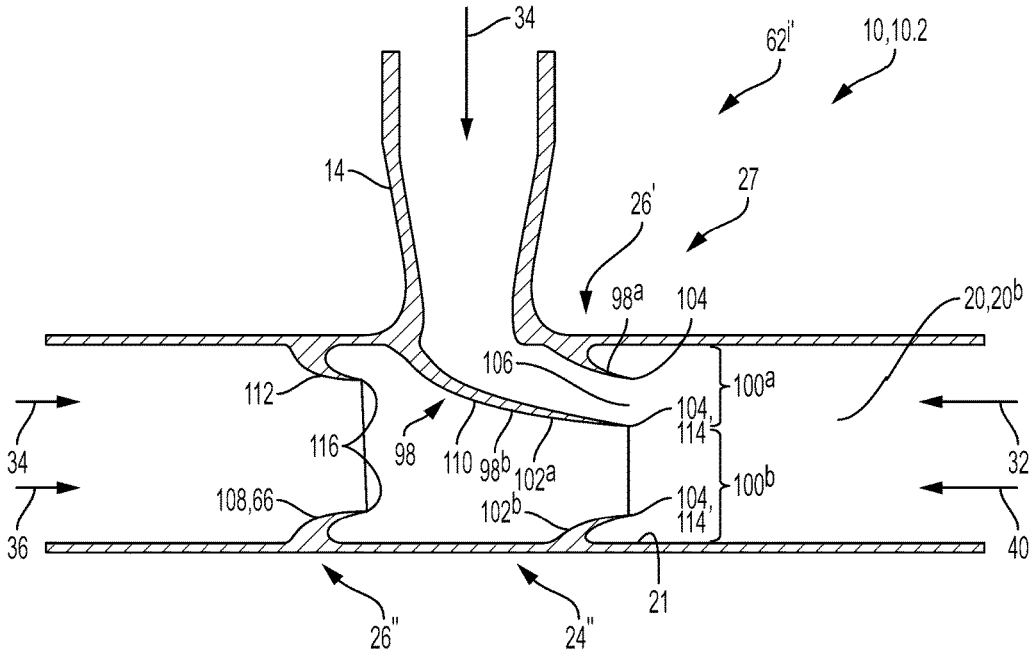
FIG. 18*c* illustrates a longitudinal cross-sectional view of the first embodiment of the portion of the second aspect of the valvular-conduit exhaust manifold illustrated in FIGS. 18*a* and 18*b;*

For example, referring to FIGS. 18*a-c*, in accordance with a first embodiment of a valvular-conduit exhaust manifold element 62$^{i}$', the collector-inlet interface structure 24"—generally in accordance with the second aspect—incorporates an extension 98 of the associated fluid-conduit runner 14 into the collector 20, 20$^{b}$ so as to provide for redirecting exhaust gases therein, and discharging exhaust gases therefrom, substantially axially along the length of the collector 20, 20$^{b}$. With the fluid-conduit runner 14 entering the upper side of the collector 20, 20$^{b}$, the lower portion 98$^{b}$ of the extension 98 divides the associated portion of the collector 20, 20$^{b}$ into upper 100$^{a}$ and lower 100$^{b}$ portions, wherein the upper portion 98$^{a}$ of the extension 98 extends across the upper portion 100$^{a}$ of the collector 20, 20$^{b}$. The lower portion 100$^{b}$ of the collector 20, 20$^{b}$ is partitioned by a lower portion 102$^{b}$ of an associated first nozzle shell element 102 that extends from the lower surface of the collector 20, 20$^{b}$, and the lower portion 98$^{b}$ of the extension 98 forms the upper portion 102$^{a}$ of the associated first nozzle shell element 102. The peripheries 104 of both the extension 98 of the associated fluid-conduit runner 14, and the first nozzle shell element 102, that extend within the interior of the collector 20, 20$^{b}$ are each sharp-edged. Accordingly, the extension 98 and the first nozzle shell element 102 collectively constitute a first fluidic-diode element 26' co-located with outlet 106 of the extension 98 of the associated fluid-conduit runner 14 within the collector 20, 20$^{b}$. A second fluidic-diode element 26" located within the collector 20, 20$^{b}$ upstream of the fluid-conduit runner 14 comprises a second nozzle shell element 66, 108, for example, in accordance with the above-described sixth embodiment illustrated in FIG. 14. Accordingly, the first 102 and second 108 nozzle shell elements present respective associated converging surfaces 110, 112 to a forward-directed bulk flow or acoustic pressure wave 34 flowing in the first direction 36 within the collector 20, 20$^{b}$, whereas the transverse peripherally-extending (e.g. circumferentially extending) relatively-constricted, sharp-edged ends 114, 116 of the associated nozzle shell elements 102, 108 provide for impeding reverse-directed bulk flow or acoustic pressure wave 32 flowing in the second direction 40 within the collector 20, 20$^{b}$. More particularly, the relatively-constricted, sharp-edged end 114 of the first fluidic-diode element 26' provides for impeding a reverse-directed bulk flow or acoustic pressure wave 32 flowing either back into the associated fluid-conduit runner 14 or further upstream within the collector 20, 20$^{b}$, whereas the relatively-constricted, sharp-edged end 116 of the second fluidic-diode element 26" provides for impeding a reverse-directed bulk flow or acoustic pressure wave 32 flowing further upstream within the collector 20, 20$^{b}$, for example, as a result of a localized pressurization downstream of the outlet 106 of the extension 98 following the intermittent discharge of exhaust gases from the associated fluid-conduit runner 14 during operation of the intermittent-combustion internal combustion engine 12.

Figure 18D:
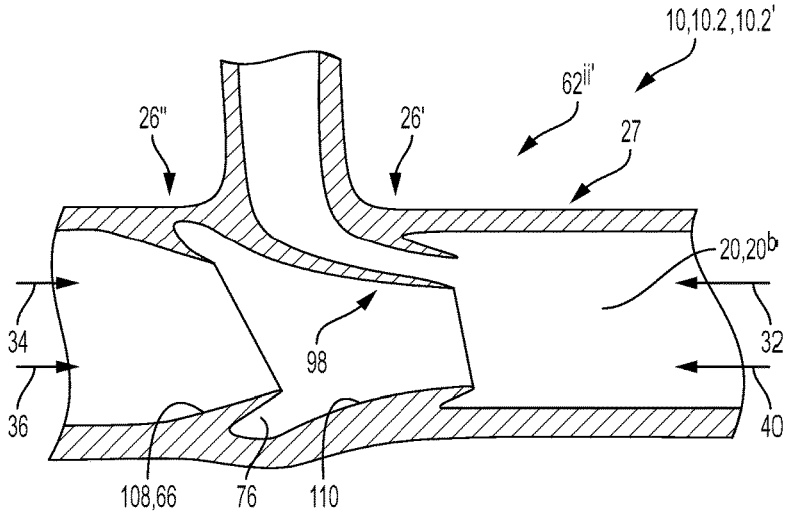
FIG. 18*d* illustrates a longitudinal cross-sectional view of a second embodiment of a portion of the second aspect of a valvular-conduit exhaust manifold.
Figure 19:
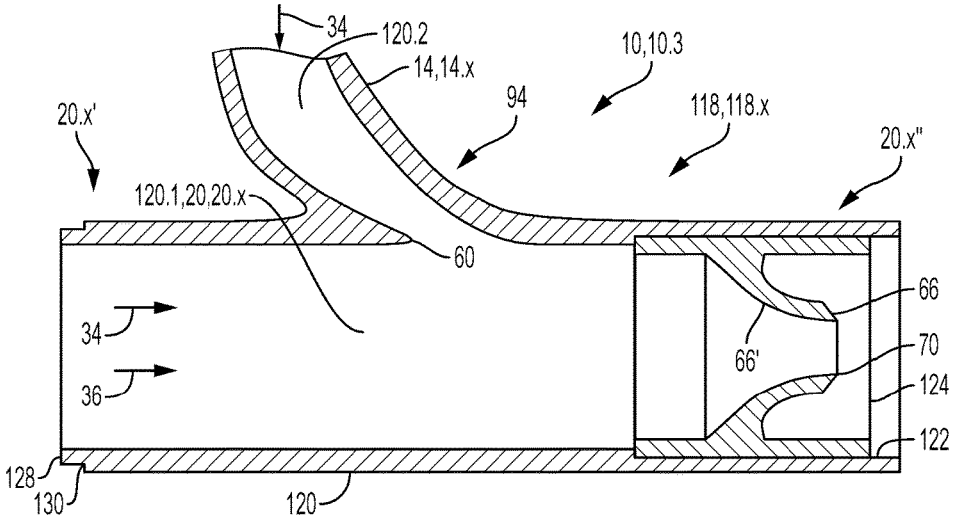
FIG. 19 illustrates a longitudinal cross-section of a valvular conduit element in accordance with a third aspect of a valvular conduit manifold.
Figure 20:
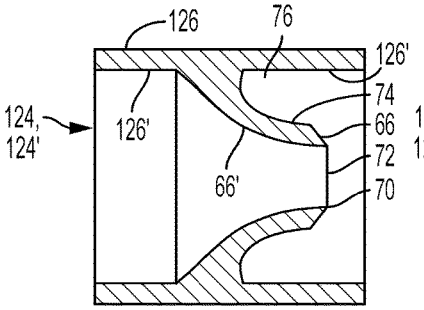
FIG. 20 illustrates a longitudinal cross-section of a first embodiment of a fluidic-diode cartridge element that is incorporated in the valvular conduit manifold element illustrated in FIG. 19.

Referring to FIG. 18*d*, in accordance with a second embodiment of the second aspect of a valvular-conduit exhaust manifold 10, 10.2', the converging surface 110 of the first fluidic-diode element 26' of the associated valvular-conduit exhaust manifold element 62$^{ii}$' extends upstream into the outer surface of the annular cavity 76 associated with the second nozzle shell element 66, 108 of the second fluidic-diode element 26" so as to provide for a wall-attached portion of an associated reverse-directed bulk flow or acoustic pressure wave 32 to be more efficiently impeded by the second fluidic-diode element 26".

The valvular-conduit exhaust manifold 10, 10.1, 10.2, 10.2' provides for damping out exhaust gas pulsations therein as a result of the intermittent discharge of exhaust gases in thereinto from an intermittent-combustion internal combustion engine 12, by impeding reverse-directed bulk flow or acoustic pressure waves 32 within the collector 20, 20$^a$, 20$^b$ and fluid-conduit runners 14 of the valvular-conduit exhaust manifold 10, 10.1, 10.2, 10.2' without more than insubstantially impeding the corresponding flow of the associated forward-directed bulk flow or acoustic pressure wave 34 therewithin, so as to improve performance both for steady-state and transient operation over a wide range of operating conditions.

Referring to FIGS. 19-25, in accordance with a third aspect, a valvular conduit manifold 10, 10.3 incorporates a plurality of valvular conduit elements 118, 118.*x*, each comprising a wye-shaped fluid conduit 120, the main flow path 120.1 of which constitutes an associate collector portion 20, 20.*x* of the valvular conduit manifold 10, 10.3, the branch flow path 120.2 of which constitutes an associated fluid-conduit runner portion 14, 14.*x* and collector-inlet interface structure 94—which is constructed in accordance with the second aspect thereof—of the valvular conduit manifold 10, 10.3.

Figure 21:
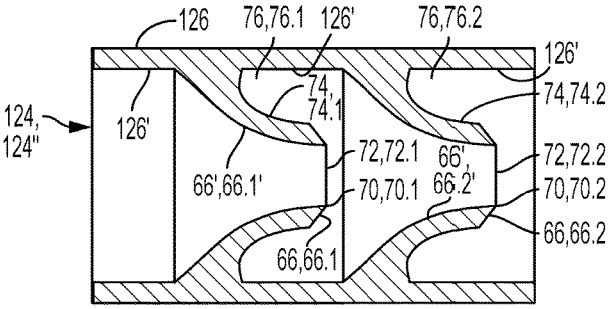
FIG. 21 illustrates a longitudinal cross-section of a second embodiment of a fluidic-diode cartridge element that may be incorporated in a valvular conduit manifold element in accordance with the third aspect of a valvular conduit manifold.

The outlet portion 20.*x*" of each valvular conduit element 118, 118.*x* incorporates a counterbore 122 within which an associated fluidic-diode cartridge element 124 is located, and oriented so as to present a relatively-higher discharge coefficient to a forward-directed bulk flow or acoustic pressure wave 34 from either the fluid-conduit runner portion 14, 14.*x* or from the main inlet portion 20.*x*' of the valvular conduit element 118, 118.*x* towards the outlet portion 20.*x*", and to present a relatively-lower discharge coefficient to a corresponding reverse-directed bulk flow or acoustic pressure wave 32. For example, referring to FIG. 20, in accordance with a first embodiment, the fluidic-diode cartridge element 124, 124' incorporates a single nozzle shell element 66, for example, as generally illustrated in FIG. 14, which is configured, and which operates, as described hereinabove, for example, depending from the interior surface 126' of an associated fluid-conduit portion 126 and comprising an associated converging interior surface 66' leading to an associated throat 72 and terminated with a transverse peripherally-extending (e.g. circumferentially extending) sharp edge 70, and comprising an associated exterior surface 74 that together with the interior surface 126' of the associated fluid-conduit portion 126, defines an associated annular cavity 76. Referring to FIG. 21, in accordance with a second embodiment, the fluidic-diode cartridge element 124, 124" incorporates a pair of nozzle shell elements 66.1, 66.2 in cooperation with one another, for example, as generally illustrated in FIGS. 9*a-c*, which are configured, and which operate, as described hereinabove, for example, with each nozzle shell element 66.1, 66.2 depending from the interior of an associated fluid-conduit portion 126 and comprising corresponding respective associated converging interior surfaces 66.1', 66.2' leading to corresponding respective associated throats 72.1, 72.2 and terminated with corresponding respective associated sharp edges 70.1, 70.2, and comprising corresponding respective associated exterior surfaces 74.1, 74.2 that together with the interior surface 126' of the associated fluid-conduit portion 126, define corresponding respective associated annular cavities 76.1, 76.2.

The outside of the main inlet portion 20.*x*' of the collector portion 20, 20.*x* of the wye-shaped fluid conduit 120 is configured to mate with the inside of the counterbore 122 of an adjacent valvular conduit element 118, 118.*x*—for example, wherein the outside diameter of the of the main inlet portion 20.*x*' of the collector portion 20, 20.*x* of the wye-shaped fluid conduit 120 is less than or equal to the inside diameter of the counterbore 122 of an adjacent wye-shaped fluid conduit 120, and possibly stepped so as to provide either the end face 128 or the step face 130, or both, of the main inlet portion 20.*x*' of the wye-shaped fluid conduit 120 to abut a corresponding face of either the fluidic-diode cartridge element 124 or the wye-shaped fluid conduit 120, respectively, of the outlet portion 20.*x*" of an adjacent valvular conduit element 118, 118.*x*—so as to provide for forming the valvular conduit manifold 10, 10.3 from an assembly of associated valvular conduit elements 118, 118.*x* abutted to one another, possibly with the main inlet portion 20.*x*' of the upstream-most valvular conduit element 118, 118.*x* closed, and with the outlet portion 20.*x*" of the downstream-most valvular conduit element 118, 118.*x* constituting the outlet 38 of the collector 20.

Figure 22:
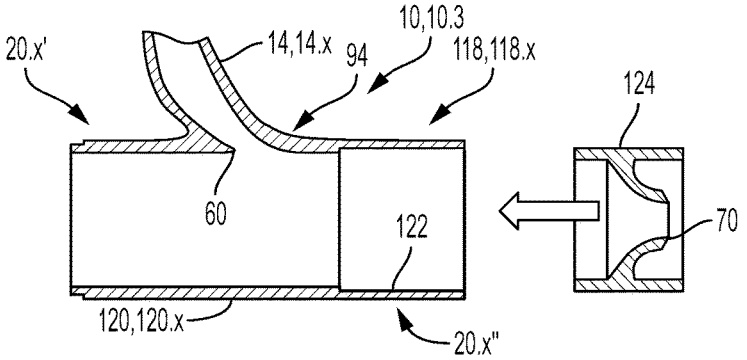
FIG. 22 illustrates the assembly of a fluidic-diode element in a wye-shaped fluid conduit so as to form the valvular conduit element illustrated in FIG. 19.
Figure 23:
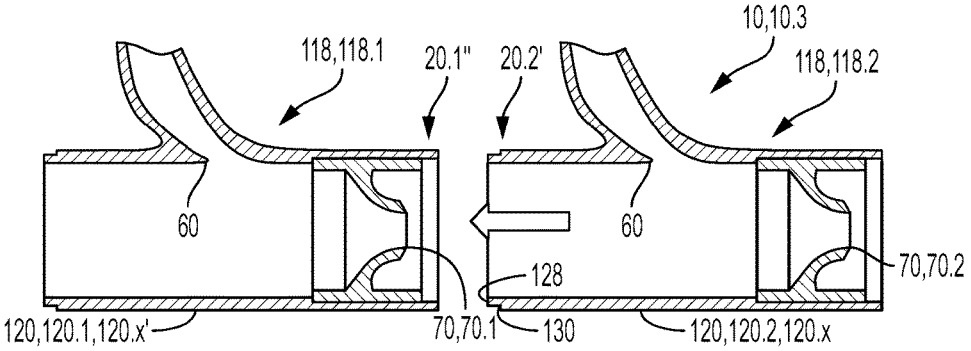
FIG. 23 illustrates the assembly of two valvular conduit elements, each as illustrated in FIG. 19, so as to form a portion of a first embodiment of the third aspect of a valvular conduit manifold.

Referring to FIGS. 22 and 23, the valvular conduit element 118, 118.*x* is constructed by first forming a counterbore 122 in an outlet portion 20.*x*" of a wye-shaped fluid conduit 120, 120.*x*, wherein the corresponding main inlet portion 20.*x*' of the wye-shaped fluid conduit 120, 120.*x* is configured so that either the outside thereof provides for mating with another wye-shaped fluid conduit 120, 120.*x*', or is sealed. Then, a fluidic-diode cartridge element 124 is inserted into the counterbore 122, with the fluidic-diode cartridge element 124 oriented so as to present a relatively-higher discharge coefficient to a forward-directed bulk flow or acoustic pressure wave 34 from either the fluid-conduit runner portion 14, 14.*x* or from the main inlet portion 20.*x*' of the valvular conduit element 118, 118.*x* towards the outlet portion 20.*x*", and to present a relatively-lower discharge coefficient to a corresponding reverse-directed bulk flow or acoustic pressure wave 32, for example, so as to smoothly converge in the first direction 36 of the forward-directed bulk flow or acoustic pressure wave 34.

Referring to FIG. 23, a portion of a valvular conduit manifold 10, 10.3 is then formed by abutting the main inlet portion 20.2' of a second valvular conduit element 118, 118.2 with an outlet portion 20.1" of a first valvular conduit element 118, 118.1, wherein the outside of the main inlet portion 20.2' of a second valvular conduit element 118, 118.2 is inserted into the counterbore 122 of the first valvular conduit element 118, 118.1, with either the end face 128 or the step face 130, or both, of the main inlet portion 20.2' of the second valvular conduit element 118, 118.2 abutting the corresponding face of either the fluidic-diode cartridge element 124 or the wye-shaped fluid conduit 120, respectively, of the outlet portion 20.1" of the first valvular conduit element 118, 118.1.

Figure 24:
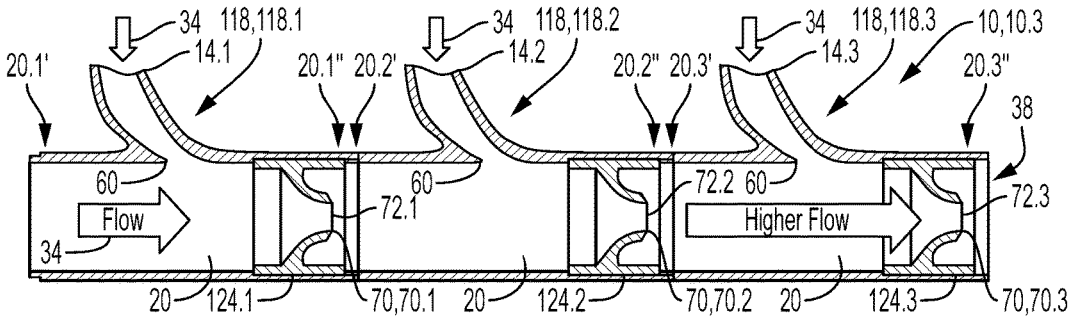
FIG. 24 illustrates a longitudinal cross-section of a portion of a second embodiment of the third aspect of a valvular conduit manifold.
Figure 25:
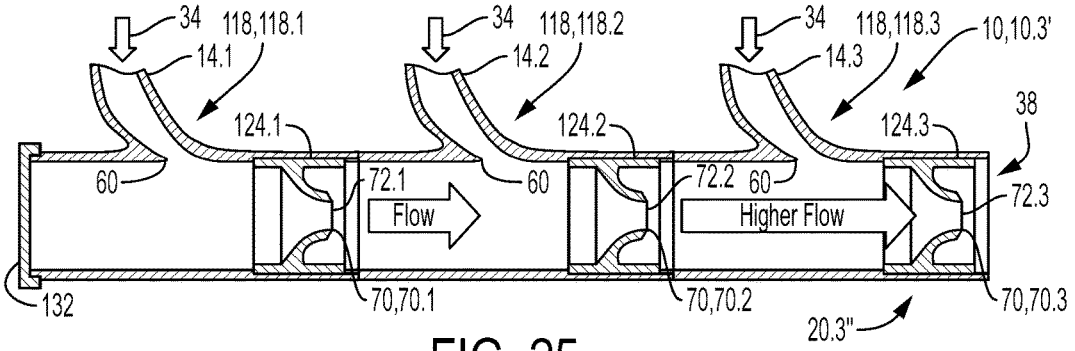
FIG. 25 illustrates a longitudinal cross-section of a third embodiment of the third aspect of a valvular conduit manifold.

In one set of embodiments, for example, as illustrated in FIGS. 23-25, the counterbores 122 in the outlet portions 20.1", 20.2", 20.3" of successive valvular conduit elements 118, 118.1, 118.2, 118.3 are all of the substantially the same size, as are the corresponding outside and inside diameters of the main inlet portions 20.1', 20.2', 20.3', so that the inside diameter of the resulting collector 20 (absent the associated fluidic-diode cartridge element 124) is substantially constant along the length of the valvular conduit manifold 10, 10.3. Alternatively, the valvular conduit elements 118, 118.*x* may be configured so that the inside diameter of the associated counterbore 122 at the outlet portion 20.*x*" thereof is greater than the outside diameter of the main inlet portion 20.*x*' thereof, so as to provide for successively increasing the associated flow area along the first direction 36 of the forward-directed bulk flow or acoustic pressure wave 34, so as to accommodate a corresponding successively increasing mass flow rate though the valvular conduit manifold 10, 10.3 as additional fluid is added to the collector 20 by each successive fluid-conduit runner portion 14, 14.*x*.

Referring to FIG. 24, the successively increasing mass flow rate through the collector 20 may also be accommodated by successive fluidic-diode cartridge elements 124, 124.1, 124.2, 124.3 that have corresponding respective throats 72.1, 72.2, 72.3 with successively increasing inside diameters.

Referring to FIG. 25, in application to a valvular conduit exhaust manifold 10, 10.3', wherein all of the fluid is supplied to the collector 20 thereof via the associated fluid-conduit runners 14, 14.1, 14.2, 14.3, the main inlet portion 20.1' of the upstream-most first valvular conduit element 118, 118.1 is sealed, for example, with a cap 132, or alternatively, having an integrally-closed end, wherein the outlet portion 20.3" of the third valvular conduit element 118, 118.3 constitutes the outlet 38 of the valvular conduit exhaust manifold 10, 10.3'.

Notwithstanding that the fluidic-diode cartridge elements 124, 124', 124", 124.1, 124.2, 124.3 are all illustrated in FIGS. 19-25 with cylindrical outside profiles, alternatively, the fluidic-diode cartridge elements 124, 124', 124", 124.1, 124.2, 124.3 could be tapered, so as to incorporate conical external profiles, so as to provide for being more securely seated within the associated counterbore 122. The corresponding outside of the main inlet portions 20.x' of the wye-shaped fluid conduit 120 could be similarly tapered.

The relatively-higher coefficient of discharge for a forward-directed bulk flow or acoustic pressure wave 34 in the first direction 36 within the collector 20, 20.*x*, 20$^a$, 20$^b$ relative to a reverse-directed bulk flow or acoustic pressure wave 32 in the second direction 40 therewithin is provided for by the effects of a) associated relatively-sharp edges 52, 60, 70, 70.1, 70.2, 70.3, 88', 114, 116 of associated elements thereof, and of b) associated flow paths that are sufficiently divergent relative to the reverse-directed bulk flow or acoustic pressure wave 32 so as to provide for relatively-inefficient diffusion thereof, resulting in a detachment of the reverse-directed bulk flow or acoustic pressure wave 32 from the surfaces of the walls of the associated divergent flow path, which effects can operate either individually or collectively within the collector 20, 20.*x*, 20$^a$, 20$^b$.

As used herein, the terms "sharp-edged" or "relatively sharp" is intended to mean a level of sharpness that is sufficient to produce associated vortices, or eddy-flows, downstream thereof for the reverse-directed bulk flow or acoustic pressure wave 32, of sufficient magnitude so as to provide for a substantial—i.e. nominally measurable—difference in the coefficients of discharge for forward- (32) and reverse- (34) directed bulk flows or acoustic pressure waves. Alternatively, for a given throat of a flow passage bounded by an associated terminating edge, for which the minimum opening dimension of the throat is designated as $T_{CRIT}$, then the associated terminating edge is considered to be "sharp-edged" or "relatively sharp" if the ratio $t_{EDGE}/T_{CRIT}$ has a value less than 0.05, wherein $t_{EDGE}$ is either twice the associated edge radius, or, for a terminating edge of an associated shell element (e.g. nozzle shell elements 66, 102 or 108), the thickness of the associated shell element.

Accordingly, in accordance with a first aspect, a valvular-conduit manifold comprises a plurality of fluid-conduit runner portions, a collector, a plurality of collector-inlet interface structures, and at least one fluidic-diode element, wherein each fluid-conduit runner portion provides for receiving fluid from a corresponding separate source of fluid, the collector incorporates a fluid conduit having a plurality of inlet ports and an outlet port, each collector-inlet interface structure of the plurality of collector-inlet interface structures comprises a fluid-conduit junction between a corresponding the fluid-conduit runner portion and the collector, an inlet port of the collector-inlet-interface structure is operatively coupled to a corresponding outlet port of the corresponding fluid-conduit runner portion, an outlet port of the collector-inlet-interface structure is operatively coupled to a corresponding inlet port of the plurality of inlet ports of the collector, the collector-inlet-interface structure provides for the collector to receive the fluid from the corresponding separate source of fluid via the fluid-conduit runner portion through the corresponding inlet port of the collector; the at least one fluidic-diode element is located within and along the collector so as to define a portion of the fluid conduit of the collector, the at least one the fluidic-diode element is located downstream of a corresponding outlet port of a corresponding collector-inlet interface structure relative to a flow through the collector towards an outlet thereof, and the at least one fluidic-diode element is shaped so as to present relatively-less drag to a flow of fluid towards the outlet of the collector, and to present relatively-more drag to a flow of fluid in a relatively-reverse direction through the collector.

Optionally, for at least one the collector-inlet interface structure, the outlet port of the at least one the collector-inlet interface structure constitutes the corresponding inlet port of the collector, and at least a portion of a periphery of the corresponding inlet port may incorporate a sharp edge. At least one the collector-inlet interface structures may incorporate a corresponding annular fluid conduit that at least partially circumscribes a transverse peripheral portion of the collector, with the annular fluid conduit in fluid communication with both a corresponding the fluid-conduit runner portion, and with an interior of the collector via an associated transverse peripherally- and axially-extending orifice, so as to provide for a radially-inward direction of flow of the fluid from the annular fluid conduit into the collector when the fluid is provided by the corresponding fluid-conduit runner portion. The at least one fluidic-diode element may incorporate a sharp-edged element that extends at least partially transverse peripherally within the collector, and that can interact with a fluid flowing within the collector. The at least one fluidic-diode element may incorporate an annular cavity that at least partially circumscribes a transverse peripheral portion of the collector, with annular cavity in fluid communication with an interior of the collector via an associated transverse peripherally- and axially-extending orifice. The junction between the annular cavity and an interior of the collector may incorporate a sharp edge. The at least one fluidic-diode element may incorporate at least one nozzle shell that is terminated with a sharp transverse peripheral edge on a downstream edge of the at least one nozzle shell relative to a flow through the collector towards the outlet port thereof. Yet further optionally, the at least one nozzle shell may define an at least partially-annularly-extending cavity that is bounded between an exterior surface of the at least one nozzle shell and an interior surface of the collector, wherein the at least partially-annularly-extending cavity is open to an interior of the collector, wherein, optionally, the at least one nozzle shell is terminated either at a location within the collector that is either co-located with or downstream of the corresponding inlet port of the collector, or at a location within the collector that is upstream of the corresponding inlet port of the collector. The collector may be configured so that a first hydraulic diameter downstream of at least one fluidic-diode element is greater than a second hydraulic diameter upstream of the at least one fluidic-diode element, relative to a flow through the collector towards the outlet port thereof. A plurality of collector-inlet interface structures may be integrated with a corresponding plurality of fluidic-diode elements so as to form a corresponding plurality of valvular-conduit exhaust manifold elements, which may be in abutment with one another.

In accordance with a second aspect, a valvular-conduit manifold, comprises a collector portion, a collector-inlet interface structure and at least one fluidic-diode element, wherein the collector portion comprises a portion of a fluid conduit that is configured to cooperate with at least one other collector portion of a corresponding at least one other valvular-conduit exhaust manifold element, incorporating an inlet through a wall of the fluid conduit and an outlet of the fluid conduit. The collector-inlet interface structure incorporates an inlet port and an outlet port, wherein the inlet port provides for receiving a fluid from a fluid-conduit runner, the outlet port in fluid communication with the inlet port through a wall of the collector portion. The at least one fluidic-diode element is located within and along the collector so as to define a portion of the fluid conduit of the collector, wherein at least one the fluidic-diode element is located downstream of a corresponding outlet port of the collector-inlet interface structure relative to a flow through the collector towards an outlet thereof, and the at least one fluidic-diode element is shaped so as to present relatively-less drag to a flow of fluid towards the outlet of the collector, and relatively-more drag to a flow of fluid in a relatively-reverse direction through the collector.

In accordance with a method of operating a manifold, a fluid is received from a plurality of fluid-conduit runners into a collector of the manifold, and a reverse-directed bulk flow or acoustic pressure wave within the collector of the manifold is relatively-more impeded relative to a corresponding forward-directed flow, wherein the forward-directed flow is in a direction towards an outlet of the collector and the reverse-directed flow is in an opposite direction to the forward direction.

In accordance with a third aspect, a fluidic-diode cartridge element for use in a valvular conduit manifold element comprises a fluid-conduit element having an outside surface configured to mate with an inside surface of a collector portion of a valvular conduit manifold element, a nozzle shell portion depending from an inside surface of the fluid-conduit element, and an annular cavity, wherein the annular cavity is bounded by a portion of the inside surface of the fluid-conduit element, and by the outside surface of the nozzle shell portion, wherein nozzle shell portion incorporates a converging inside surface that extends from the inside surface of the fluid-conduit element and terminates at a sharp edge. The fluidic-diode cartridge element is configured to be incorporated inside a main-end portion of wye-shaped fluid conduit, wherein the main-end potion is located at an end of the wye-shaped fluid conduit to which a fluid entering a branch of the wye-shaped fluid conduit flows, and the fluidic-diode element is oriented so that the sharp edge is relatively downstream relative to a remainder of the nozzle shell portion, relative to a direction of the fluid flowing as a result of entry into the branch of the wye-shaped fluid conduit.

It should be understood that notwithstanding the illustration herein of an application to an exhaust manifold for used with an internal combustion engine, that the valvular-conduit manifold is not limited to such applications, nor is the type of fluid to which the valvular-conduit manifold may be adapted limiting. For example, the valvular-conduit manifold could be adapted to work with either gaseous or liquid fluids. Furthermore, it should be understood that the number of fluidic-diode element in relation to the number of collector inlet ports is also not limiting. For example, a single fluidic-diode element—for example, located between the collector outlet port and the associated collector inlet port closest thereto—could be used in cooperation with a collector having a plurality of associated collector inlet ports.

While specific embodiments have been described in detail in the foregoing detailed description and illustrated in the accompanying drawings, those with ordinary skill in the art will appreciate that various modifications and alternatives to those details could be developed in light of the overall teachings of the disclosure. It should be understood, that any reference herein to the term "or" is intended to mean an "inclusive or" or what is also known as a "logical OR", wherein when used as a logic statement, the expression "A or B" is true if either A or B is true, or if both A and B are true, and when used as a list of elements, the expression "A, B or C" is intended to include all combinations of the elements recited in the expression, for example, any of the elements selected from the group consisting of A, B, C, (A, B), (A, C), (B, C), and (A, B, C); and so on if additional elements are listed. Furthermore, it should also be understood that the indefinite articles "a" or "an", and the corresponding associated definite articles "the" or "said", are each intended to mean one or more unless otherwise stated, implied, or physically impossible. Yet further, it should be understood that the expressions "at least one of A and B, etc.", "at least one of A or B, etc.", "selected from A and B, etc." and "selected from A or B, etc." are each intended to mean either any recited element individually or any combination of two or more elements, for example, any of the elements from the group consisting of "A", "B", and "A AND B together", etc. Yet further, it should be understood that the expressions "one of A and B, etc." and "one of A or B, etc." are each intended to mean any of the recited elements individually alone, for example, either A alone or B alone, etc., but not A AND B together. Furthermore, it should also be understood that unless indicated otherwise or unless physically impossible, that the above-described embodiments and aspects can be used in combination with one another and are not mutually exclusive. Accordingly, the particular arrangements disclosed are meant to be illustrative only and not limiting as to the scope of the invention, which is to be given the full breadth of the appended claims, and any and all equivalents thereof.

What is claimed is:

1. A valvular-conduit manifold, comprising:

a. a plurality of fluid-conduit runner portions, wherein each fluid-conduit runner portion of said plurality of fluid-conduit runner portions provides for receiving fluid from a corresponding separate source of fluid;

b. a collector, wherein said collector comprises a fluid conduit having a plurality of collector inlet ports and an outlet port;

c. a plurality of collector-inlet interface structures, wherein at least one collector-inlet interface structure of said plurality of collector-inlet interface structures comprises:

i. a branch inlet portion operatively coupled to, and in fluid communication with, a corresponding said fluid-conduit runner portion;

ii. a main inlet portion; and iii. an outlet portion, wherein said main inlet portion is in fluid communication with said outlet portion via a fluid conduit portion of said at least one collector-inlet interface structure defining a corresponding portion of said fluid conduit of said collector, said branch inlet portion is in fluid communication with said outlet portion via a corresponding collector inlet port of said plurality of collector inlet ports, said at least one collector-inlet interface structure provides for said collector to receive a fluid from said corresponding separate source of fluid via said corresponding said fluid-conduit runner portion through said corresponding collector inlet port, said branch inlet portion is oriented relative to said collector so as to provide for discharging said fluid received from said corresponding said fluid-conduit runner portion in a direction that is substantially towards said outlet port of said collector, said corresponding collector inlet port is at least partially bounded by a relatively-sharp-edged junction with said fluid conduit, at least one said branch inlet portion of said at least one collector-inlet interface structure comprises a corresponding annular fluid conduit that at least partially circumscribes a transverse peripheral portion of said collector, and said corresponding collector inlet port comprises an associated transverse peripherally-and-axially-extending orifice, so as to provide for a radially-inward direction of flow of said fluid from said corresponding annular fluid conduit into said collector when said fluid is provided by said corresponding said fluid-conduit runner portion; and d. at least one fluidic-diode element, wherein said at least one fluidic-diode element is located within, along, and in series with said collector so as to define a corresponding portion of said fluid conduit of said collector, said at least one fluidic-diode element is located either coincident with, or downstream of, said corresponding collector inlet port relative to a direction of flow through said collector towards said outlet port thereof, and said at least one fluidic-diode element is shaped so as to present a relatively-higher coefficient of discharge for said fluid flowing towards said outlet port of said collector, and to present a relatively-lower said coefficient of discharge for fluid flowing in a relatively-reverse direction therethrough.

2. A valvular-conduit manifold as recited in claim 1, wherein said at least one fluidic-diode element comprises a transverse peripherally-extending relatively-sharp-edged element within said fluid conduit of said collector.

3. A valvular-conduit manifold as recited in claim 1, wherein said at least one fluidic-diode element comprises at least one nozzle shell element that is terminated with a relatively-sharp transverse peripherally-extending edge on a downstream edge of said at least one nozzle shell element relative to a flow through said collector towards said outlet port thereof.

4. A valvular-conduit manifold as recited in claim 3, wherein said at least one nozzle shell element defines an at least partially-annularly-extending cavity that is located between an exterior surface of said at least one nozzle shell element and an interior surface of said fluid conduit of said collector, and said at least partially-annularly-extending cavity is open to an interior of said fluid conduit of said collector.

5. A valvular-conduit manifold as recited in claim 4, wherein said at least one nozzle shell element is terminated at a location within said fluid conduit of said collector that is either co-located with, or downstream of, said corresponding collector inlet port of said collector.

6. A valvular-conduit manifold as recited in claim 4, wherein said at least one nozzle shell element is terminated at a location within said collector that is upstream of said corresponding collector inlet port.

7. A valvular-conduit manifold as recited in claim 3, wherein said at least one nozzle shell element comprises at least first and second nozzle shell elements, wherein said first nozzle shell element is relatively upstream of said second nozzle shell element.

8. A valvular-conduit manifold, comprising:

a. a plurality of fluid-conduit runner portions, wherein each fluid-conduit runner portion of said plurality of fluid-conduit runner portions provides for receiving fluid from a corresponding separate source of fluid;

b. a collector, wherein said collector comprises a fluid conduit having a plurality of collector inlet ports and an outlet port;

c. a plurality of collector-inlet interface structures, wherein at least one collector-inlet interface structure of said plurality of collector-inlet interface structures comprises:

i. a branch inlet portion operatively coupled to, and in fluid communication with, a corresponding said fluid-conduit runner portion;

ii. a main inlet portion; and iii. an outlet portion, wherein said main inlet portion is in fluid communication with said outlet portion via a fluid conduit portion of said at least one collector-inlet interface structure defining a corresponding portion of said fluid conduit of said collector, said branch inlet portion is in fluid communication with said outlet portion via a corresponding collector inlet port of said plurality of collector inlet ports, said at least one collector-inlet interface structure provides for said collector to receive a fluid from said corresponding separate source of fluid via said corresponding said fluid-conduit runner portion through said corresponding collector inlet port, said branch inlet portion is oriented relative to said collector so as to provide for discharging said fluid received from said corresponding said fluid-conduit runner portion in a direction that is substantially towards said outlet port of said collector, said corresponding collector inlet port is at least partially bounded by a relatively-sharp-edged junction with said fluid conduit, at least one said branch inlet portion extends within said fluid conduit of said collector, and said relatively-sharp-edged junction is located within said fluid conduit of said collector and transversely extends across a portion of a flow path thereof; and d. at least one fluidic-diode element, wherein said at least one fluidic-diode element is located within, along, and in series with said collector so as to define a corresponding portion of said fluid conduit of said collector, said at least one fluidic-diode element is located either coincident with, or downstream of, said corresponding collector inlet port relative to a direction of flow through said collector towards said outlet port thereof, and said at least one fluidic-diode element is shaped so as to present a relatively-higher coefficient of discharge for said fluid flowing towards said outlet port of said collector, and to present a relatively-lower said coefficient of discharge for fluid flowing in a relatively-reverse direction therethrough.

9. A valvular-conduit manifold as recited in claim 8, wherein said at least one fluidic-diode element comprises a transverse peripherally-extending relatively-sharp-edged element within said fluid conduit of said collector.

10. A valvular-conduit manifold as recited in claim 8, wherein said at least one fluidic-diode element comprises at least one nozzle shell element that is terminated with a relatively-sharp transverse peripherally-extending edge on a downstream edge of said at least one nozzle shell element relative to a flow through said collector towards said outlet port thereof.

11. A valvular-conduit manifold as recited in claim 10, wherein said at least one nozzle shell element defines an at least partially-annularly-extending cavity that is located between an exterior surface of said at least one nozzle shell element and an interior surface of said fluid conduit of said collector, and said at least partially-annularly-extending cavity is open to an interior of said fluid conduit of said collector.

12. A valvular-conduit manifold as recited in claim 11, wherein said at least one nozzle shell element is terminated at a location within said fluid conduit of said collector that is either co-located with, or downstream of, said corresponding collector inlet port of said collector.

13. A valvular-conduit manifold as recited in claim 11, wherein said at least one nozzle shell element is terminated at a location within said collector that is upstream of said corresponding collector inlet port.

14. A valvular-conduit manifold as recited in claim 10, wherein said at least one nozzle shell element comprises at least first and second nozzle shell elements, wherein said first nozzle shell element is relatively upstream of said second nozzle shell element.

15. A valvular-conduit manifold, comprising:

a. a plurality of fluid-conduit runner portions, wherein each fluid-conduit runner portion of said plurality of fluid-conduit runner portions provides for receiving fluid from a corresponding separate source of fluid;

b. a collector, wherein said collector comprises a fluid conduit having a plurality of collector inlet ports and an outlet port;

c. a plurality of collector-inlet interface structures, wherein at least one collector-inlet interface structure of said plurality of collector-inlet interface structures comprises:

i. a branch inlet portion operatively coupled to, and in fluid communication with, a corresponding said fluid-conduit runner portion;

ii. a main inlet portion; and iii. an outlet portion, wherein said main inlet portion is in fluid communication with said outlet portion via a fluid conduit portion of said at least one collector-inlet interface structure defining a corresponding portion of said fluid conduit of said collector, said branch inlet portion is in fluid communication with said outlet portion via a corresponding collector inlet port of said plurality of collector inlet ports, said at least one collector-inlet interface structure provides for said collector to receive a fluid from said corresponding separate source of fluid via said corresponding said fluid-conduit runner portion through said corresponding collector inlet port, said branch inlet portion is oriented relative to said collector so as to provide for discharging said fluid received from said corresponding said fluid-conduit runner portion in a direction that is substantially towards said outlet port of said collector, said corresponding collector inlet port is at least partially bounded by a relatively-sharp-edged junction with said fluid conduit; and d. at least one fluidic-diode element, wherein said at least one fluidic-diode element is located within, along, and in series with said collector so as to define a corresponding portion of said fluid conduit of said collector, said at least one fluidic-diode element is located either coincident with, or downstream of, said corresponding collector inlet port relative to a direction of flow through said collector towards said outlet port thereof, said at least one fluidic-diode element is shaped so as to present a relatively-higher coefficient of discharge for said fluid flowing towards said outlet port of said collector, and to present a relatively-lower said coefficient of discharge for fluid flowing in a relatively-reverse direction therethrough, and said at least one fluidic-diode element comprises an annular cavity that at least partially circumscribes a transverse peripheral portion of said collector, and said annular cavity is in fluid communication with an interior of said collector via an associated transverse peripherally- and axially-extending orifice.

16. A valvular-conduit manifold as recited in claim 15, wherein a junction between said annular cavity and said interior of said collector comprises a relatively-sharp edge.

17. A valvular-conduit manifold as recited in claim 15, wherein said at least one fluidic-diode element comprises a transverse peripherally-extending relatively-sharp-edged element within said fluid conduit of said collector.

18. A valvular-conduit manifold as recited in claim 15, wherein said at least one fluidic-diode element comprises at least one nozzle shell element that is terminated with a relatively-sharp transverse peripherally-extending edge on a downstream edge of said at least one nozzle shell element relative to a flow through said collector towards said outlet port thereof.

19. A valvular-conduit manifold as recited in claim 18, wherein said at least one nozzle shell element defines an at least partially-annularly-extending cavity that is located between an exterior surface of said at least one nozzle shell element and an interior surface of said fluid conduit of said collector, and said at least partially-annularly-extending cavity is open to an interior of said fluid conduit of said collector.

20. A valvular-conduit manifold as recited in claim 19, wherein said at least one nozzle shell element is terminated at a location within said fluid conduit of said collector that is either co-located with, or downstream of, said corresponding collector inlet port of said collector.

21. A valvular-conduit manifold as recited in claim 19, wherein said at least one nozzle shell element is terminated at a location within said collector that is upstream of said corresponding collector inlet port.

22. A valvular-conduit manifold as recited in claim 18, wherein said at least one nozzle shell element comprises at least first and second nozzle shell elements, wherein said first nozzle shell element is relatively upstream of said second nozzle shell element.

23. A valvular-conduit manifold, comprising:

a. a plurality of fluid-conduit runner portions, wherein each fluid-conduit runner portion of said plurality of fluid-conduit runner portions provides for receiving fluid from a corresponding separate source of fluid;

b. a collector, wherein said collector comprises a fluid conduit having a plurality of collector inlet ports and an outlet port;

c. a plurality of collector-inlet interface structures, wherein at least one collector-inlet interface structure of said plurality of collector-inlet interface structures comprises:

i. a branch inlet portion operatively coupled to, and in fluid communication with, a corresponding said fluid-conduit runner portion;

ii. a main inlet portion; and iii. an outlet portion, wherein said main inlet portion is in fluid communication with said outlet portion via a fluid conduit portion of said at least one collector-inlet interface structure defining a corresponding portion of said fluid conduit of said collector, said branch inlet portion is in fluid communication with said outlet portion via a corresponding collector inlet port of said plurality of collector inlet ports, said at least one collector-inlet interface structure provides for said collector to receive a fluid from said corresponding separate source of fluid via said corresponding said fluid-conduit runner portion through said corresponding collector inlet port, said branch inlet portion is oriented relative to said collector so as to provide for discharging said fluid received from said corresponding said fluid-conduit runner portion in a direction that is substantially towards said outlet port of said collector, and said corresponding collector inlet port is at least partially bounded by a relatively-sharp-edged junction with said fluid conduit; and d. at least one fluidic-diode element, wherein said at least one fluidic-diode element is located within, along, and in series with said collector so as to define a corresponding portion of said fluid conduit of said collector, said at least one fluidic-diode element is located either coincident with, or downstream of, said corresponding collector inlet port relative to a direction of flow through said collector towards said outlet port thereof, said at least one fluidic-diode element is shaped so as to present a relatively-higher coefficient of discharge for said fluid flow flowing towards said outlet port of said collector, and to present a relatively-lower said coefficient of discharge for fluid flowing in a relatively-reverse direction therethrough, said at least one fluidic-diode element comprises at least one nozzle shell element that is terminated with a relatively-sharp transverse peripherally-extending edge on a downstream edge of said at least one nozzle shell element relative to a flow through said collector towards said outlet port thereof, said at least one nozzle shell element comprises at least first and second nozzle shell elements, wherein said first nozzle shell element is relatively upstream of said second nozzle shell element, and a hydraulic diameter of a throat of said first nozzle shell element is relatively smaller than a hydraulic diameter of a throat of said second nozzle shell element.

24. A valvular-conduit manifold as recited in claim 23, wherein said at least one fluidic-diode element comprises a transverse peripherally-extending relatively-sharp-edged element within said fluid conduit of said collector.

25. A valvular-conduit manifold as recited in claim 23, wherein said at least one fluidic-diode element comprises at least one nozzle shell element that is terminated with a relatively-sharp transverse peripherally-extending edge on a downstream edge of said at least one nozzle shell element relative to a flow through said collector towards said outlet port thereof.

26. A valvular-conduit manifold as recited in claim 25, wherein said at least one nozzle shell element defines an at least partially-annularly-extending cavity that is located between an exterior surface of said at least one nozzle shell element and an interior surface of said fluid conduit of said collector, and said at least partially-annularly-extending cavity is open to an interior of said fluid conduit of said collector.

27. A valvular-conduit manifold as recited in claim 26, wherein said at least one nozzle shell element is terminated at a location within said fluid conduit of said collector that is either co-located with, or downstream of, said corresponding collector inlet port of said collector.

28. A valvular-conduit manifold as recited in claim 26, wherein said at least one nozzle shell element is terminated at a location within said collector that is upstream of said corresponding collector inlet port.

29. A valvular-conduit manifold as recited in claim 25, wherein said at least one nozzle shell element comprises at least first and second nozzle shell elements, wherein said first nozzle shell element is relatively upstream of said second nozzle shell element.

30. A valvular-conduit manifold, comprising:

a. a plurality of fluid-conduit runner portions, wherein each fluid-conduit runner portion of said plurality of fluid-conduit runner portions provides for receiving fluid from a corresponding separate source of fluid;

b. a collector, wherein said collector comprises a fluid conduit having a plurality of collector inlet ports and an outlet port;

c. a plurality of collector-inlet interface structures, wherein at least one collector-inlet interface structure of said plurality of collector-inlet interface structures comprises:

i. a branch inlet portion operatively coupled to, and in fluid communication with, a corresponding said fluid-conduit runner portion;

ii. a main inlet portion; and iii. an outlet portion, wherein said main inlet portion is in fluid communication with said outlet portion via a fluid conduit portion of said at least one collector-inlet interface structure defining a corresponding portion of said fluid conduit of said collector, said branch inlet portion is in fluid communication with said outlet portion via a corresponding collector inlet port of said plurality of collector inlet ports, said at least one collector-inlet interface structure provides for said collector to receive a fluid from said corresponding separate source of fluid via said corresponding said fluid-conduit runner portion through said corresponding collector inlet port, said branch inlet portion is oriented relative to said collector so as to provide for discharging said fluid received from said corresponding said fluid-conduit runner portion in a direction that is substantially towards said outlet port of said collector, and said corresponding collector inlet port is at least partially bounded by a relatively-sharp-edged junction with said fluid conduit; and d. at least one fluidic-diode element, wherein said at least one fluidic-diode element is located within, along, and in series with said collector so as to define a corresponding portion of said fluid conduit of said collector, said at least one fluidic-diode element is located either coincident with, or downstream of, said corresponding collector inlet port relative to a direction of flow through said collector towards said outlet port thereof, said at least one fluidic-diode element is shaped so as to present a relatively-higher coefficient of discharge for said fluid flowing towards said outlet port of said collector, and to present a relatively-lower said coefficient of discharge for fluid flowing in a relatively-reverse direction therethrough, and said collector is configured so that a first hydraulic diameter of a corresponding first portion of said collector downstream of at least one fluidic-diode element is greater than a second hydraulic diameter of a corresponding second portion of said collector upstream of said at least one fluidic-diode element, relative to a flow through said collector towards said outlet port thereof.

31. A valvular-conduit manifold as recited in claim 30, wherein said at least one fluidic-diode element comprises a transverse peripherally-extending relatively-sharp-edged element within said fluid conduit of said collector.

32. A valvular-conduit manifold as recited in claim 30, wherein said at least one fluidic-diode element comprises at least one nozzle shell element that is terminated with a relatively-sharp transverse peripherally-extending edge on a downstream edge of said at least one nozzle shell element relative to a flow through said collector towards said outlet port thereof.

33. A valvular-conduit manifold as recited in claim 32, wherein said at least one nozzle shell element defines an at least partially-annularly-extending cavity that is located between an exterior surface of said at least one nozzle shell element and an interior surface of said fluid conduit of said collector, and said at least partially-annularly-extending cavity is open to an interior of said fluid conduit of said collector.

34. A valvular-conduit manifold as recited in claim 33, wherein said at least one nozzle shell element is terminated at a location within said fluid conduit of said collector that is either co-located with, or downstream of, said corresponding collector inlet port of said collector.

35. A valvular-conduit manifold as recited in claim 33, wherein said at least one nozzle shell element is terminated at a location within said collector that is upstream of said corresponding collector inlet port.

36. A valvular-conduit manifold as recited in claim 32, wherein said at least one nozzle shell element comprises at least first and second nozzle shell elements, wherein said first nozzle shell element is relatively upstream of said second nozzle shell element.

37. A valvular-conduit manifold element, comprising:

a. a collector portion, wherein said collector portion comprises a portion of a fluid conduit that is configured to cooperate with at least one other collector portion of a corresponding at least one other valvular-conduit manifold element;

b. a branch inlet portion, wherein said branch inlet portion is in fluid communication with said collector portion through a wall of said portion of said fluid conduit of said collector portion via an associated collector inlet port, said branch inlet portion is oriented relative to said collector portion so as to provide for discharging a fluid therefrom into said collector portion in a direction that is substantially towards an outlet port of said collector portion, and said collector inlet port is at least partially bounded by a relatively-sharp-edged junction with said portion of said fluid conduit; and c. at least one fluidic-diode element, wherein said at least one fluidic-diode element is located within, along, and in series with said collector portion so as to define a portion of said portion of said fluid conduit, at least one said at least one fluidic-diode element is located either coincident with or downstream of said collector inlet port relative to a direction of flow through said collector portion towards an outlet thereof, and said at least one fluidic-diode element is shaped so as to present a relatively-higher coefficient of discharge for said fluid flowing towards said outlet of said collector portion, and to present a relatively-lower said coefficient of discharge for said fluid flowing in a relatively-reverse direction therethrough.

38. A valvular-conduit manifold element as recited in claim 37, wherein an outlet portion of said collector portion incorporates a cylindrical or conically-tapered counterbore, and at least one said at least one fluidic-diode element is incorporated in a fluidic-diode cartridge element inserted in said counterbore of said outlet portion of said collector portion.

39. A fluidic-diode cartridge element for use in a valvular conduit manifold element, comprising:

a. a fluid-conduit element having an outside surface configured to mate with an inside surface of a collector portion of the valvular conduit manifold element;

b. a nozzle shell element depending from an inside surface of said fluid-conduit element, wherein said nozzle shell element comprises:

i. a converging inside surface extending from said inside surface of said fluid-conduit element, wherein said converging inside surface terminates at a relatively-sharp edge within an interior of said fluid-conduit element; and ii. an outside surface; and c. an annular cavity, wherein said annular cavity is located between a portion of said inside surface of said collector portion of the valvular conduit manifold element and said outside surface of said nozzle shell element, and the mating of said outside surface of said fluid-conduit element to said inside surface of said collector portion of said valvular conduit manifold element provides for causing substantially all fluid flowing through said fluid-conduit element to flow through said nozzle shell element.

40. A fluidic-diode cartridge element for use in a valvular conduit manifold element as recited in claim 39, wherein the fluidic-diode cartridge element is incorporated inside an outlet-end portion of a wye-shaped fluid conduit, said outlet-end portion is located at an end of said wye-shaped fluid conduit to which a fluid entering a branch of said wye-shaped fluid conduit flows, and said fluidic-diode cartridge element is oriented so that said relatively-sharp edge is relatively downstream relative to a remainder of said nozzle shell element, relative to a direction of said fluid flowing after entering said branch of said wye-shaped fluid conduit.

* * * * *